US005873513A

United States Patent [19]

Ong

[11] Patent Number: 5,873,513

[45] Date of Patent: Feb. 23, 1999

[54] FOLIO

[76] Inventor: Bon S. Ong, P.O. Box 4247, Torrance, Calif. 90510

[21] Appl. No.: 753,379

[22] Filed: Nov. 25, 1996

Related U.S. Application Data

[63] Continuation of Ser. No. 419,900, Apr. 11, 1995, Pat. No. 5,598,969.

[51] Int. Cl.[6] ..... B65D 5/02

[52] U.S. Cl. ..... 229/67.1; 229/67.4; 229/72; 281/29; 281/31; 402/80 R

[58] Field of Search ..... 229/67.1, 67.2, 229/67.3, 67.4, 72, 68.1; 150/139, 145, 147; 206/312; 281/29, 30, 31, 38; 402/79, 80 R

[56] References Cited

U.S. PATENT DOCUMENTS

| | | | |
|---|---|---|---|
| 212,762 | 2/1879 | Stromberg | 281/31 X |
| 647,067 | 4/1900 | Bellairs | 150/139 |
| 2,378,020 | 6/1945 | Langworthy | 229/72 X |
| 2,718,911 | 9/1955 | Solomon | 229/72 X |
| 3,847,195 | 11/1974 | Tyrseck | 229/72 X |
| 3,883,069 | 5/1975 | Volkert | 229/68.1 X |
| 4,534,581 | 8/1985 | Engh | 229/72 X |

FOREIGN PATENT DOCUMENTS

| | | | |
|---|---|---|---|
| 511235 | 8/1939 | United Kingdom | 229/72 |

*Primary Examiner*—Jes F. Pascua
*Attorney, Agent, or Firm*—Charles H. Thomas

[57] ABSTRACT

A folio is comprised of a sheet of flat, expansive panel stock having a backing region and a document retention region that is folded about a laterally-extending fold or folds against the backing region. The sheet is also folded longitudinally perpendicular to the laterally-extending fold in articulated fashion to define a plurality of panels or leaves. Specifically, the longitudinal folds form a pair of mutually-adjacent interior panels and a pair of side panels. A separate one of the side panels is joined to each of the interior panels by longitudinal side panel delineating folds. Each of the side panels has one bound edge and one unbound edge. The bound edges of the side panels are secured to each other, preferably by means of transition webs that are defined between the side panels and the interior panels. The folio may include a jacket within which the sheet of folded stock forming the interior panels and side panels is encompassed. The document retention portion of the structure may take the form of pockets defined onto the various panels or document retention tabs that are punched to receive conventional pronged fasteners for securing papers punched at the top.

9 Claims, 23 Drawing Sheets

FOLIO

SPECIFICATION

The present invention is a continuation in part of U.S. application Ser. No. 08/419,900 filed Apr. 11, 1995,now U.S. Pat. No. 5,598,969.

BACKGROUND OF THE INVENTION

1. Field of the Invention

The present invention relates to a folio in which at least four panels or leaves, at least some of which include extensions for retaining documents, are formed from a single sheet of folded stock.

2. Description of the Prior Art

Office file folders have been used for many years to carry and protect papers and to serve as a means for organizing sheets of paper. One very simple and widely used form of folder is an office folio formed of an expansive sheet of stiff paper or card stock folded longitudinally to bifurcate the sheet into two leaves which fold together. The leaves serve as front and back covers of a file folder. Quite often the single sheet of material forming the folio includes extensions from the leaves. These extensions are folded back and secured to the leaves to form stiffening, marginal strips and sometimes pockets on the inside of either the front cover, the back cover, or on the insides of both covers of the folio.

Conventional folio folders of this type are very economical to manufacture and are widely utilized throughout many different types of offices and businesses. However, conventional folio folders of this type have only a very limited storage and organizing capacity. That is, in forming a folio folder of this type from a single sheet of flat stock the storage and organizing capacity of the folder is limited to a single pocket defined on the inside of the front folio cover and a single pocket defined on the inside of the back folio cover. Thus, if a user wishes to separate papers into more than two categories, additional, separate folio folders must be employed.

Where a user wishes to organize papers into several categories it is often cumbersome to be forced to carry, sort, and refer to a number of different folio folders. Also, it is oftentimes inconvenient to attempt to physically manipulate several different folio folders in order to locate particular papers stored in one of the folders.

SUMMARY OF THE INVENTION

One object of the present invention is to produce a folio which expands the capacity and reduces the physical manipulation of papers necessary to separate and categorize papers to be organized within a folder or binder. According to the invention a folio is provided which contains one or more pockets, document tabs punched to accommodate fasteners for securing papers together that are hole punched at the top, or both pockets and apertured document attachment flaps. The folded sheet of stock forming the leaves or panels may constitute the entire folio according to some embodiments of the invention. Alternatively, this single, folded sheet of stock may be inserted into and attached to a jacket, which may be of the type used to form conventional bifurcated office folders of the type previously described.

While many of the embodiments of the folded sheet of mounting-panel stock of the invention are particularly adapted for insertion into a conventional bifolding folio folder, the utility of the invention is not limited to such applications. Indeed, some of the embodiments of the invention include only the single, flat sheet of panel stock folded to form panels with pockets or document mounting flaps thereon for use independently of any folder, and also for use as a hanging file folder.

In one broad aspect the present invention may be considered to be a folio comprising a sheet of flat, expansive, panel stock having an upper region and a lower region wherein the lower region is folded upwardly against the upper region about a laterally-extending, pocket-delineating fold. The sheet is also folded longitudinally in articulated fashion to define a pair of mutually-adjacent, interior panels and a pair of side panels. A separate one of the side panels is joined to each of the interior panels by side panel delineating folds that extend perpendicular to the pocket delineating fold. Each of the side panels has one bound edge and one unbound edge both extending perpendicular to the pocket-delineating fold. The bound edges of the side panels are secured to each other.

In some embodiments of the invention the panel stock sheet is folded so that the interior panels reside in back-to-back relationship, joined to each other by a central, bifurcating fold along unbound, mutually adjacent edges. The interior panels are attached at their opposing edges by some fastening means that also secures the bound edges of the side panels to each other. In the fabrication of such a folio, once the sheet of panel stock has been folded along fold lines running widthwise to define the pockets, it is folded longitudinally at its center into a generally V-shaped configuration. The sheet is then folded again longitudinally on both sides of the center to create a pair of wings extending outwardly from the V-shaped central portion. This structure thereupon defines interior panels immediately adjacent to the central fold, while the wing portions form side panels. The interior panels are thereupon joined together in a back-to-back disposition, typically by heat sealing, an adhesive, or staples extending linearly along the side edges of the interior panels immediately adjacent to the adjoining side panels.

According to one modification of such an embodiment of the invention, one of the side panels may be equipped with a closure flap extending laterally from its unbound edge. A releasable closure means, for example a flexible fabric hook and loop fastener system, may be provide on the flap and on the other side panel for releasably holding the closure flap folded over the unbound edge of the other side panel.

To form a folio of alternative construction according the invention, the folds can be reversed. That is, once the lower region has been folded up against the upper region, the single sheet of panel stock may be folded into a generally W-shaped configuration by three longitudinal folds spaced substantially equally from each other and from the ends of the sheet of stock across the width thereof. In this configuration the stock is folded to form a pair of interior panels that face each other, and a pair of side panels. The side panels are then pressed toward the interior panels so that each side panel resides in back-to-back relationship relative to the adjoining interior panel from which it is delineated by a longitudinal fold. In this arrangement the interior panels face inwardly toward each other, while the side panels face outwardly on opposite sides of the interior panels.

In another broad aspect the invention may be considered to be a folio comprising a single expansive sheet of flat stock formed of backing and document retention portions. The sheet of stock defines a pair of interior leaves and a pair of side leaves. The document retention portions of the sheet of flat stock are folded to only partially cover the backing portion thereof. The document retention portions thereby form separate document retainers on at least some of the leaves. The interior leaves reside in mutually adjacent relationship and are joined in articulated fashion to each other and to separate ones of the side leaves. Each of the side leaves has a bound edge and an unbound edge. The side leaves are bound to each other along their bound edges.

In still another broad aspect the invention may be considered to be a folio comprising a single expansive sheet of flat stock having a length, a width, a backing section, and at least one document retention section. The backing section and the at least one document retention section are delineated from each other by at least one linear document retention section demarcation fold extending in the direction of the width of the sheet. The at least one document retention section is folded against the backing section. A pair or mutually-adjacent, interior panels are formed in the backing section and delineated from each other by at least one interior panel-separating fold that extends in the direction of the height of the sheet through the backing section and perpendicular to the at least one document retention section demarcation fold. A pair of side panels are formed in the backing section. Each of the side panels has a pair of longitudinal side edges parallel to the direction of the height of the sheet. Each side panel resides adjacent to a separate one the interior panels and is delineated therefrom by a separate side panel fold parallel to the direction of the height of the sheet. The side panel folds extend throughout the entire height of the backing section. One side edge of each of the side panels is secured throughout its length to a side edge of the other of the side panels.

The invention may be described with greater clarity and particularity by reference to the accompanying drawings.

DESCRIPTION OF THE EMBODIMENTS

Figure 1:
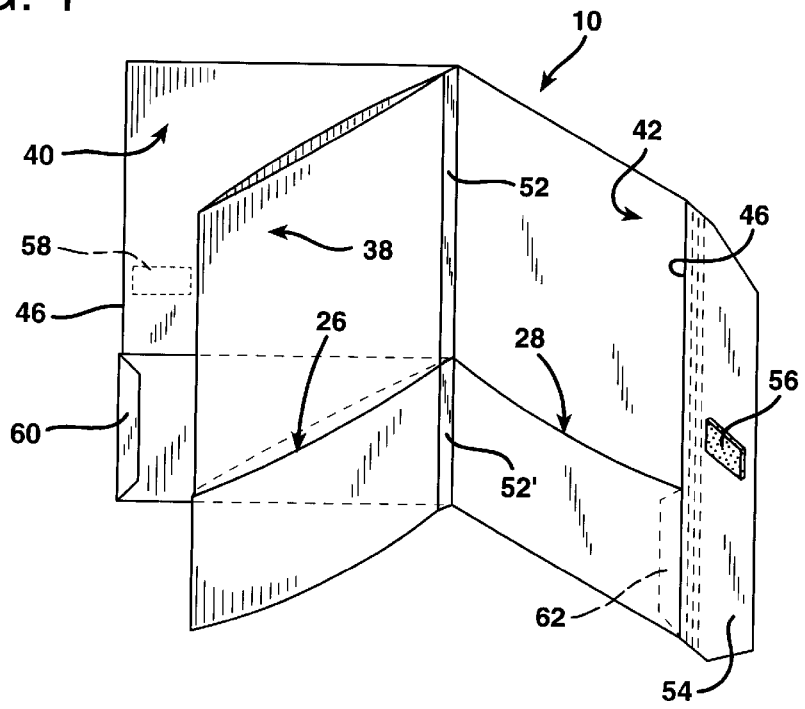
FIG. 1 is a perspective view illustrating one embodiment of a folio constructed according to the invention.
Figure 2:
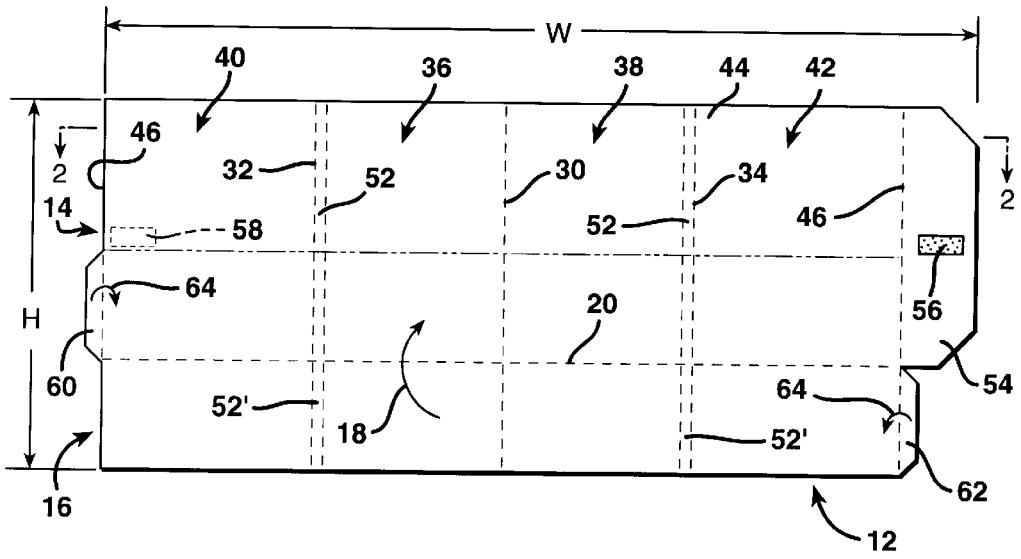
FIG. 2 is a top plan view of the single sheet of panel stock employed to form the folio shown in FIG. 1.

FIG. 1 is a perspective view illustrating a complete folio 10 formed of a sheet of flat, expansive panel stock 12, illustrated in FIG. 2 in its unfolded condition prior to construction of the complete folio 10. The expansive sheet of flat panel stock 12 may be formed of plastic, such as polyethylene or polyvinyl chloride, or of paper or card stock. The sheet 12 in its unfolded condition has a length indicated at H and a width indicated at W. The sheet 12 has an upper region 14 that may be considered to be a backing section or portion and a lower region 16 that may be considered to be a document retention section or portion.

Figure 3:
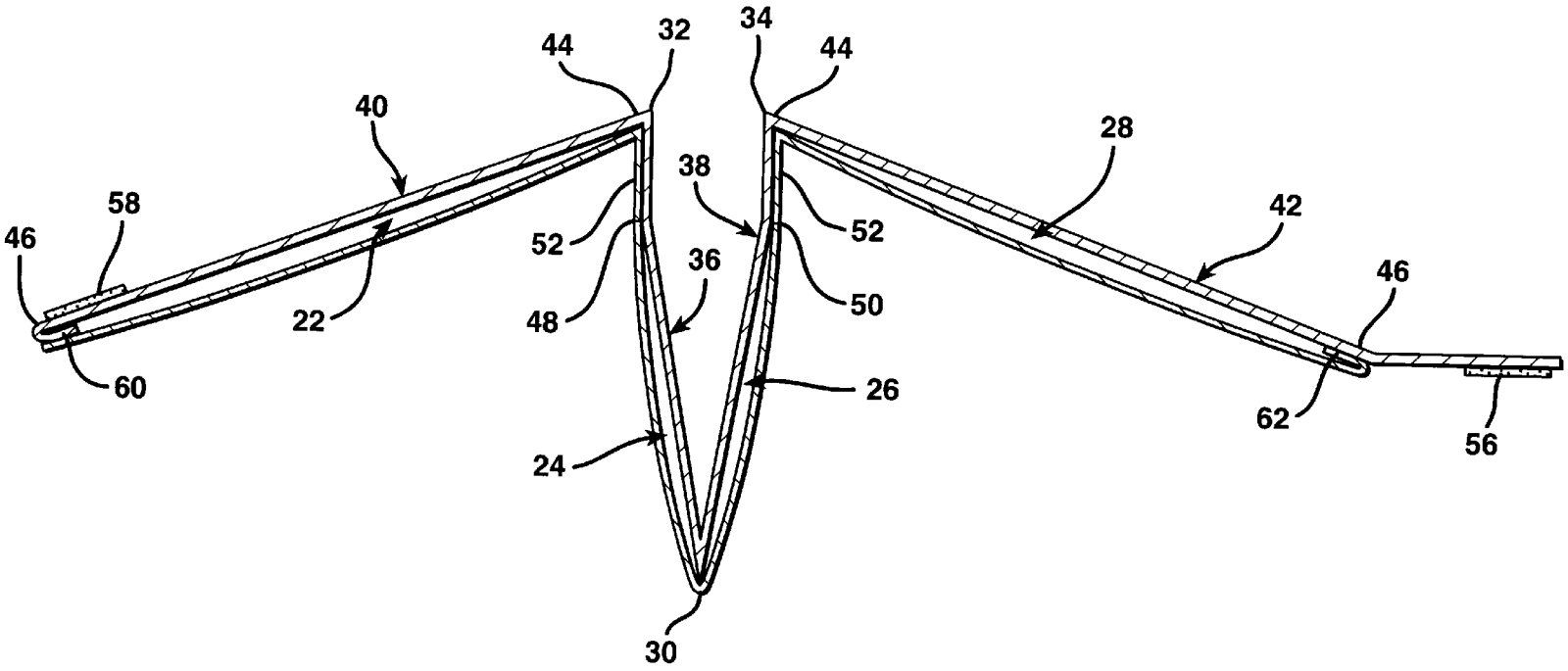
FIG. 3 is a sectional elevational view taken along the lines 3—3 of FIG. 2, showing the folio of FIG. 1 at an intermediate stage of completion.

In the construction of the folio 10 the document retention portion 16 is first folded upwardly relative to the backing portion 14 in the direction indicated by the directional arrow 18 about a laterally-extending, pocket-delineating pocket retention section demarcation fold 20 that extends in the direction of the width W of the sheet 12. As illustrated in FIGS. 1 and 3, the document retention section 16 is folded up against the backing section 14 to form pockets 22, 24, 26, and 28. The sheet 12 is also folded longitudinally along a central, bifurcating fold line 30 and along panel delineating fold lines 32 and 34, spaced laterally on either side of the central fold line 30 in the direction of the width W of the sheet 12. The folds along lines 30, 32, and 34 extend longitudinally in the direction of the height H of the sheet 12 and perpendicular to the document retention section demarcation fold 20. The longitudinal folds along lines 30, 32, and 34 divide the sheet 12 in articulated fashion to define a pair of mutually adjacent interior panels or leaves 36 and 38 and a pair of side panels or leaves 40 and 42. All of the panels 36, 38, 40, and 42 that are formed on the backing section 14 have a rectangular configuration and are large enough to provide a suitable backing for the most commonly used sizes of paper, which typically measures eight and a half inches in width by eleven inches in height in this country.

As best illustrated in FIG. 1, the document retention portion 16 of the sheet 12, when folded up along the pocket delineating fold line 20, only partially covers the backing section 14 and thereby forms separate document retaining pockets. In the embodiment of FIGS. 1–3, the folded document retention section 16 forms a separate pocket 22, 24, 26, and 28 for each of the panels 40, 36, 38, and 42 respectively.

The interior panels 36 and 38 formed in the backing section 14 reside in mutually adjacent relationship and are joined in articulated fashion to each other. The interior panels 36 and 38 are delineated from each other by the bifurcating fold along line 30 that extends in the direction of the height H of the sheet 12 through both the backing section 14 and the document retention section 16 and perpendicular to the document retention section demarcation fold along line 20. As best illustrated in FIG. 3, the side panel 40 is joined to the interior panel 36 by a side panel delineation fold along fold line 32, while the side panel 42 is joined to the interior panel 38 by a side panel delineation fold along longitudinal fold line 34. These side panel delineating folds 32 and 34 extend perpendicular to the pocket delineating fold along line 20. Each of the side panels 40 and 42 has a bound side edge 44 and an unbound side edge 46. The side edges 44 and 46 all extend perpendicular to the pocket delineating fold 20.

In the embodiment of FIGS. 1–3, the sheet of panel stock 12 is further folded longitudinally along fold lines 48 and 50 to define narrow, longitudinally-elongated transition webs 52 between each of the interior panels 36 and 38 and the side panels 40 and 42 to which the interior panels 36 and 38 are respectively joined. The transition webs 52 reside in back-to-back relationship to each other and are permanently sealed together throughout the length of the upper backing section 14 of the sheet of panel stock 12 by some conventional means such as adhesive, heat sealing, staples, or any other means. By securing the transition webs 52 together, the bound edges 44 of the side panels 40 and 42 are firmly and permanently secured to each other, as illustrated in FIG. 1.

The portions of the document retention section 16 that are longitudinally aligned with the webs 52 are narrow pocket closure strips 52'. The pocket closure strips 52' reside against and are permanently secured to the lower portions of the outwardly facing surfaces of the webs 52, also by some conventional means such as adhesive, heat sealing, staples, or other means. The pocket closure strips 52' thereby close the inner ends of the pockets 22, 24, 26, and 28 at the webs 52.

The sheet 12 is also provided with laterally-extending pocket closure tabs 60 and 62. The pocket closure tab 60 extends laterally in the direction of the width of the sheet 12 from that part of the side panel 40 that adjoins the lower, document retention section 16 of the sheet 12, while the pocket closure tab 62 extends laterally from the lower, document retention section 16 of the sheet 12 adjoining the lower part of the side panel 42 on the opposite side of the fold line 20 therefrom.

In constructing the folio 10, the pocket closure tabs 60 and 62 are folded inwardly, as indicated by the directional arrows 64 in FIG. 2, and are firmly and permanently secured to the opposing areas of the sheet 12 which they face. That is, the fastening tab 60 is secured, typically by heat sealing, sonic welding, staples, or adhesive, to the outer margin of that portion of the lower region 16 that faces the side panel 40 immediately adjacent the unbound edge 46 thereof. The pocket closure tab 62, on the other hand, is secured to the marginal area of the side panel 42 immediately adjacent the unbound edge 46 thereof. The fastening tabs 60 and 62 thereby close the outer, lateral ends of the pockets 22 and 28.

In the embodiment of FIGS. 1–3 the sheet 12 is provided with a closure flap 54 extending laterally from the unbound edge 46 of one of the side panels, namely the side panel 42. The folio 10 is provided with a releasable closure means on the flap 54 and on the other side panel 40 for releasably holding the closure flap 54 on the unbound edge 46 of the side panel 42 folded over the unbound edge 46 of the other side panel 40. Specifically, in the embodiment illustrated a flexible fabric hook and loop fastening system is employed. A pad 56 is permanently secured to the inside face of the closure flap 54. The pad 56 bears a multiplicity of tiny, outwardly-projecting fabric hooks. A corresponding, mating pad 58 is secured to the outside surface of the side panel 40 near the unbound edge 46 thereof. The pad 58 bears a looped pile which, upon contact, releasably engages the multiplicity of minute hooks on the pad 56. The folio 10 can thereupon be closed so that the interior panels 36 and 38 and the pocket bearing surfaces of the side panels 40 and 42, and all of the pockets 22, 24, 26, and 28 are encompassed within the closed folio 10.

Figure 4:
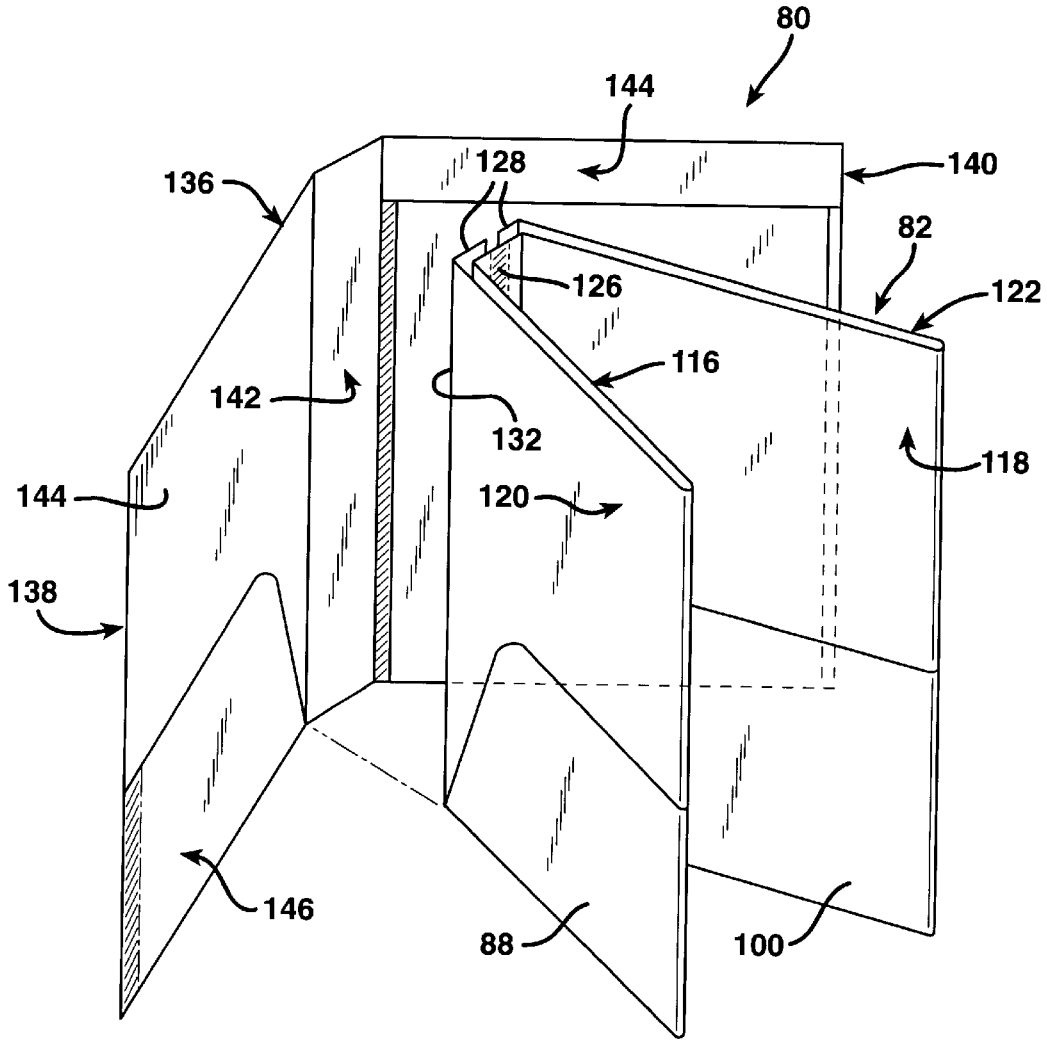
FIG. 4 is an exploded perspective view illustrating an alternative embodiment of a folio constructed according to the invention and employing a single sheet of folded panel stock together with a jacket.
Figure 5:
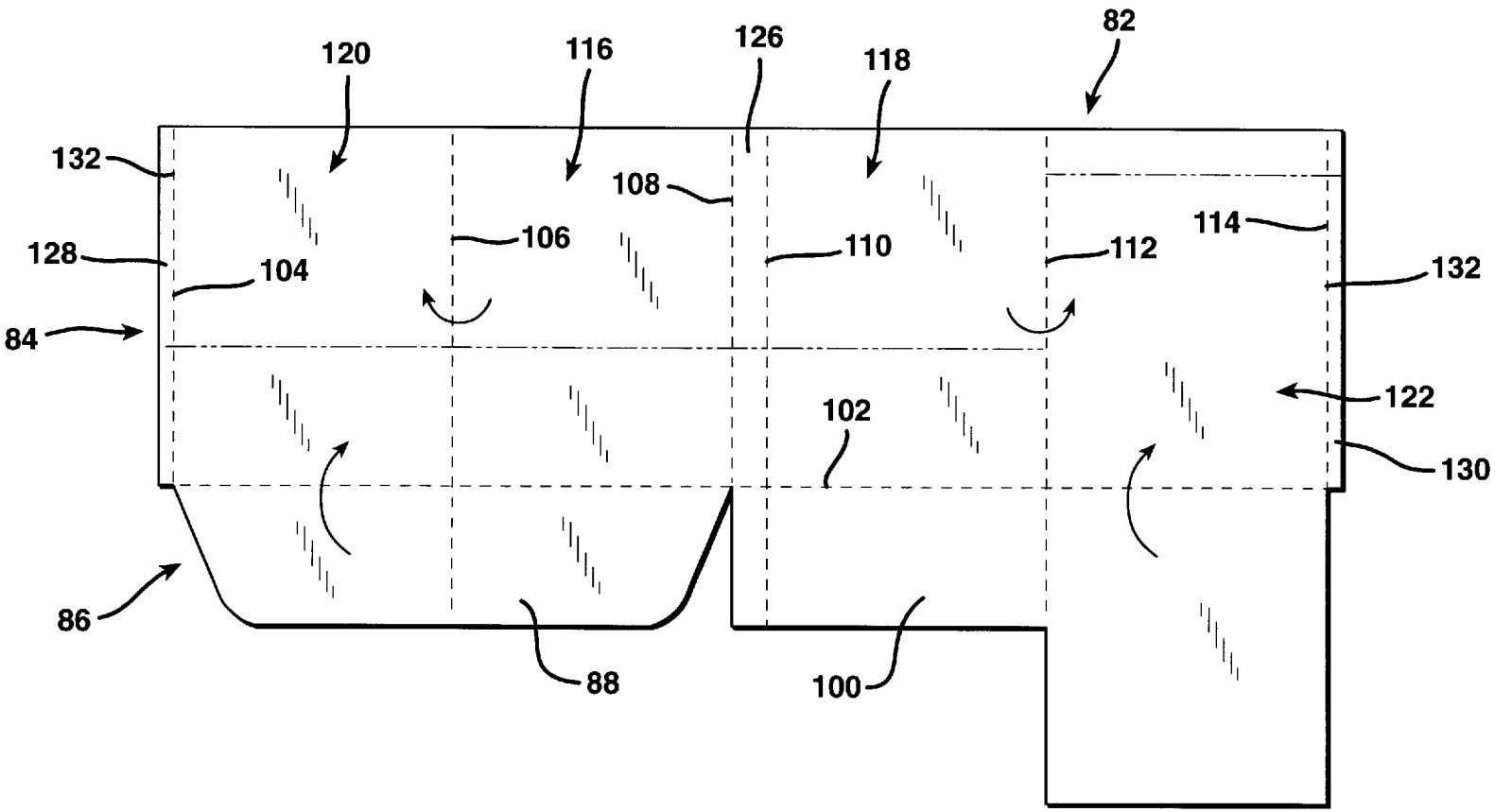
FIG. 5 is a top plan view illustrating the sheet of panel stock employed in the folio of FIG. 4 prior to folding.

FIGS. 4 and 5 illustrate another folio 80 constructed according to the invention. Like the folio 10, the folio 80 includes a single, expansive sheet 82 of flat, polypropylene, polyvinyl chloride, or polyethylene plastic, or paper or card stock. The sheet 82 is likewise provided with an upper backing region 84 and a lower pocket-forming region 86. The pocket forming region 86 has two separate pocket flaps 88 and 100 that are folded upwardly relative to the backing region 84 along a single, linear, elongated fold line 102 that extends the entire width of the sheet 82. Once the lower region 86 has been folded upwardly, the sheet 82 is folded longitudinally through both the regions 84 and 86 by longitudinal folds 104, 106, 108, 110, 112, and 114 to form a pair of interior panels 116 and 118 and a pair of side panels 120 and 122.

In the embodiment of FIGS. 4 and 5 the portion of the pocket flap 100 that folds upwardly into a face-to-face disposition relative to the side panel 122 is nearly equal in height to the side panel 122. Consequently, a very deep pocket is formed on the outwardly facing surface of the side panel 122. Such a top-loading pocket is suitable for receiving the cardboard backing of a lined pad of paper.

As illustrated in FIGS. 4 and 5, the outside edges of the pocket flap 88 are inclined relative to the fold line 102. As a consequence, when the pocket flap 88 is folded upwardly against the backing section 84, the pockets formed by the pocket panel 88 have diagonally-opening, unsecured edges.

In the folio 80 of FIG. 4, each of the panels 116, 118, 120, and 122 has a planar surface and an opposing pocket-bearing surface. The planar surfaces of the interior panels 116 and 118 are held in back-to-back disposition with the planar surfaces of the side panels 120 and 122 to which they are respectively secured. Unlike the folded sheet 12, the folded sheet 80 is further comprised of an elongated, relatively narrow spine panel 126 that is located between the interior panels 116 and 118. Also, the folded sheet 82 has edge extensions 128 and 130 located at each of the bound edges 132 of the side panels 120 and 122.

The edge extensions 128 and 130 extend the entire height of the upper backing region and reside in contact with the spine panel 126 when the expansive sheet 82 is folded as depicted in FIG. 4. The edge extensions 128 and 130 are sealed throughout their lengths to the spine panel 126 by heat sealing, sonic welding, or by adhesive. By sealing the edge extensions 128 and 130 to the back side of the spine panel 126, the planar surfaces of the interior panel 116 and the side panel 120 are held concealed in mutual contact with each other, with the opposing, pocket-bearing sides of those panels facing outwardly. Likewise, the planar surfaces of the interior panel 118 and the side panel 122 are held concealed in mutually-facing relationship with the opposing, pocket-bearing surfaces thereof facing outwardly.

Unlike the folio 10, the folio 80 is fabricated not only from a single sheet of folded stock 82, but also includes a jacket 136 that is divided longitudinally to define a front cover 138, a back cover 140, and a spine 142. The jacket 136 may be formed of a single sheet of cover stock, or it may be a composite structure in which fiberboard is encased within an overlying plastic cover. The front and back covers 138 and 140 both have interior faces 144 and both include pockets 146 formed on the interior faces 144 of the jacket 136.

The bound edges 132 of the side panels 120 and 122 of the folded sheet of stock 82 and the interior panels 116 and 118 of the folded sheet of stock 82 are secured to the jacket 136 between the front cover 138 and the back cover 140 thereof. Specifically, the spine panel 126, and the end extensions 128 and 130 of the folded sheet of stock 82 are not only secured together by adhesive, sonic welding, or heat sealing, but are also secured by adhesive, sonic welding, or heat sealing to the spine 142 of the jacket 136.

Figure 6:
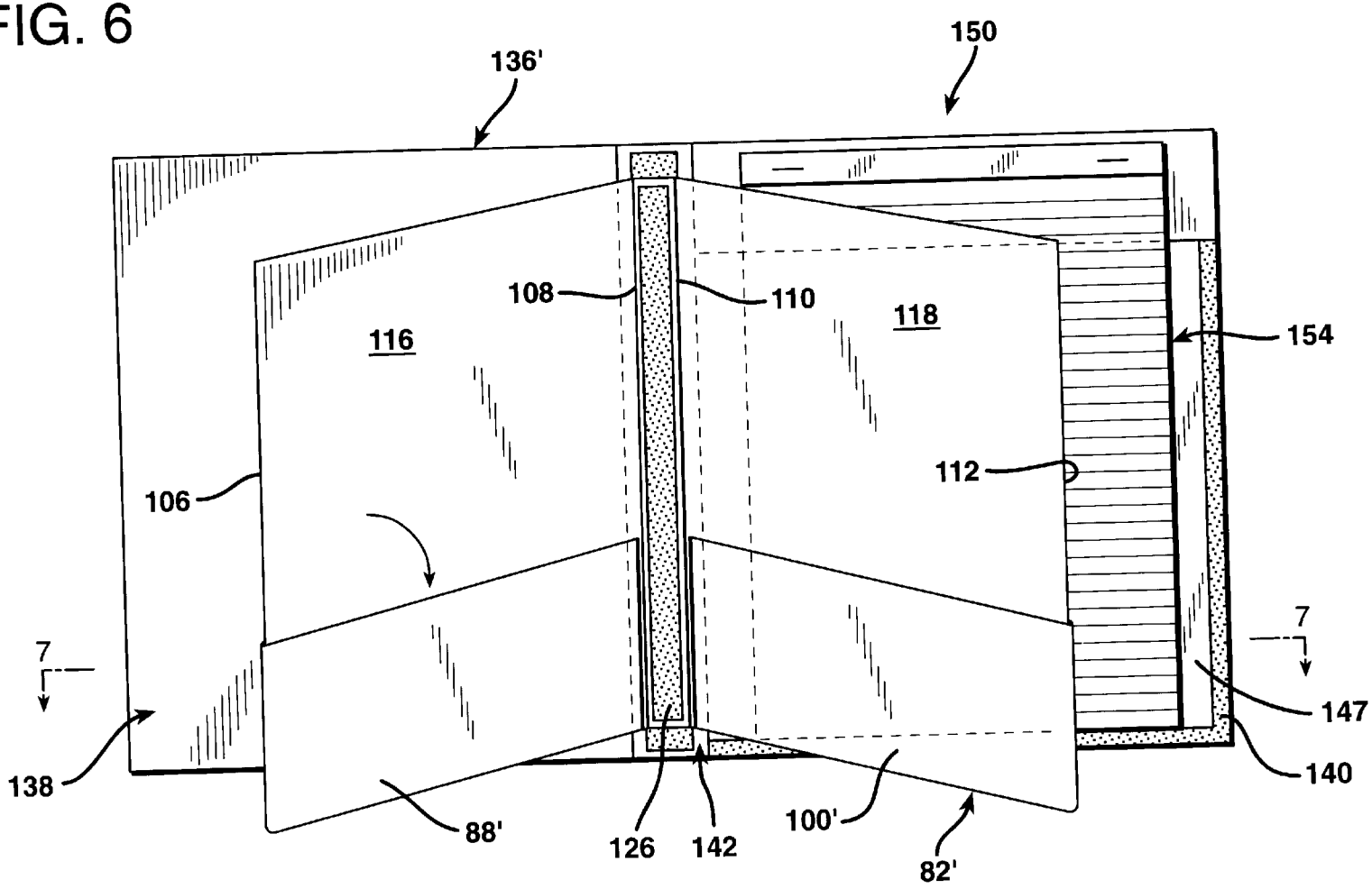
FIG. 6 is a perspective view illustrating an alternative embodiment of a folio to that depicted in FIG. 4.
Figure 7:
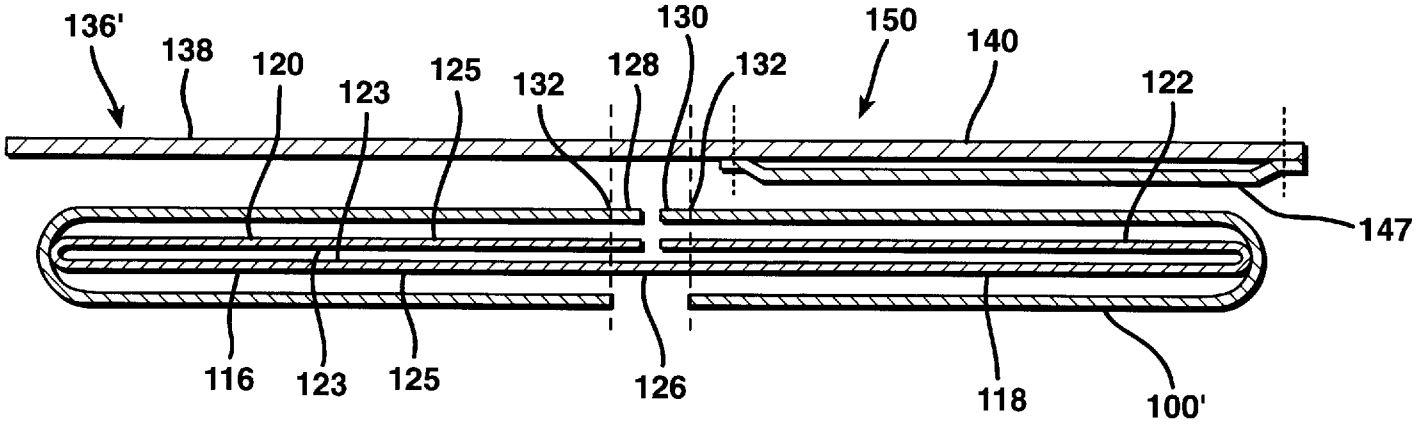
FIG. 7 is an exploded sectional elevational view of the folder of FIG. 6 taken along the lines 7—7 thereof.
Figure 8:
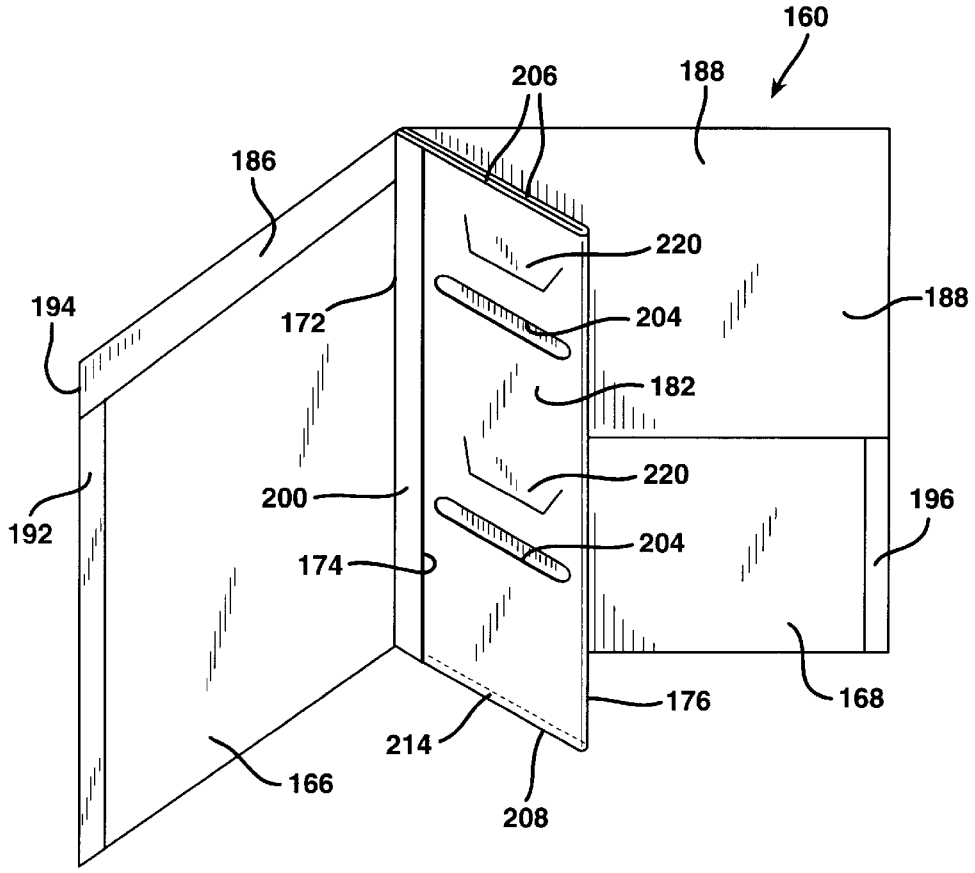
FIG. 8 is a perspective view of still another embodiment of a folio constructed according to the present invention.
Figure 9:
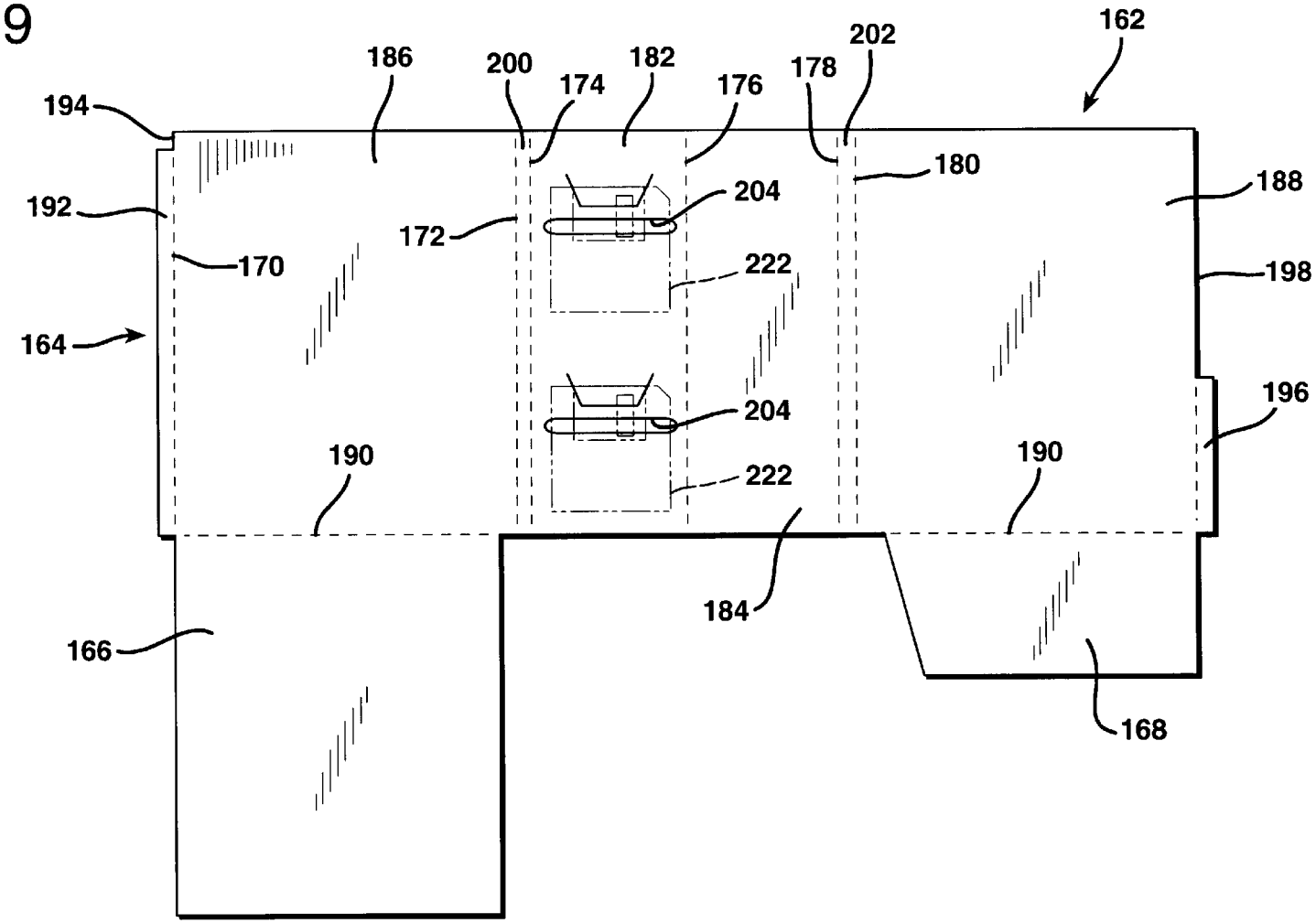
FIG. 9 illustrates the single sheet of panel stock prior to folding that is employed in the fabrication of the folio of FIG. 8.

FIGS. 6 and 7 illustrate another folio 150 which is similar in many respects to the folio 80. Components of the folio 150 which are common to the folio 80 bear corresponding reference numbers.

Like the folio 80, the folio 150 is formed from a single folded sheet 82' of flat stock and also includes a jacket 136'. As in the folio 80, each of the panels 116, 118, 120, and 122 has a planar surface 123 and an opposing pocket-bearing surface 125. As best illustrated in FIG. 7, the planar surfaces 123 of the interior panels 116, and 118 are held in back-to-back disposition with the planar surfaces 123 of the side panels 120 and 122 to which they are respectively secured. A spine panel 126 is located between the interior panels 116 and 118 and edge extensions 128 and 130 are located at each of the bound edges 132 of the side panels 120 and 122. The edge extensions 128 and 130 reside in contact with the spine panel 126 and are secured by adhesive, sonic welding, or heat sealing thereto.

The only significant difference between the folios 80 and 150 is that the pocket panels 88' are not cut diagonally, and the pocket panel 100' does not extend across the face of the spine panel 126, but rather terminates at the edge of the interior panel 118. In FIG. 6 a lined note pad 154 is shown with its cardboard backing inserted into the pocket defined by the pocket panel 147 on the inside surface of the back cover 140. In the folio 150, no pocket is formed on the inside surface 144 of the cover 138.

FIGS. 8–11 illustrate another embodiment of a folio 160 constructed according to the invention. The folio 160 is formed of a single, flat, folded sheet 162, illustrated prior to folding in FIG. 9. The sheet 162 is likewise formed of polypropylene, polyvinyl chloride, paper, or card stock. The sheet 162 has a backing portion 164 and document retention portions which are pocket flaps 166 and 168 that form pockets for retaining documents. Longitudinal folds 170, 172, 174, 176, 178, and 180 define a pair of interior leaves 182 and 184 and a pair of side leaves 186 and 188. The pocket flaps 166 and 168 are folded upwardly about the fold line 190 that extends in the direction of the width of the sheet 162 and delineates the backing portion 164 from the pocket flaps 166 and 168.

The pocket flaps 166 and 168 are smaller than the side leaves 186 and 188 against which they are respectively folded, so that they only partially cover them. The side leaf 186 is provided with a longitudinally-extending, marginal pocket fastening flap 192 along its unbound edge 194. The pocket fastening flap 192 is folded inwardly along the fold line 170 once the pocket flap 166 has been folded up against the side leaf 186. The pocket fastening flap 192 overlies and is secured by adhesive, heat sealing, or sonic welding to the laterally outer marginal surface of the pocket flap 166. Likewise, the pocket fastening flap 196 on the unbound edge 198 of the side panel 188 is folded over the outside margin of the pocket flap 168 once the pocket flap 168 has been folded up against the side panel 188. The pocket fastening flap 196 is coated with adhesive before being pressed against the facing marginal surface of the pocket flap 168. Alternatively the pocket fastening flap 196 may be secured to the pocket flap 168 by heat sealing or sonic welding.

The longitudinal folds 174, 176, and 178 delineate the pair of interior panels or leaves 182 and 184. The sheet of panel stock 162 is further folded longitudinally at 172 and 180 to define transition webs 200 and 202 between each of the interior panels 182 and 184 and the side panels 186 and 188 to which the interior panels 182 and 184 are respectively joined. The transition webs 200 and 202 are disposed back to back and are sealed together throughout the entire length of the backing region 164.

The bound edges of the side leaves 186 and 188 are delineated by the fold lines 172 and 180. The seal between the transition webs 200 and 202 anchors the bound edges of the side leaves 186 and 188 together.

Figure 10:
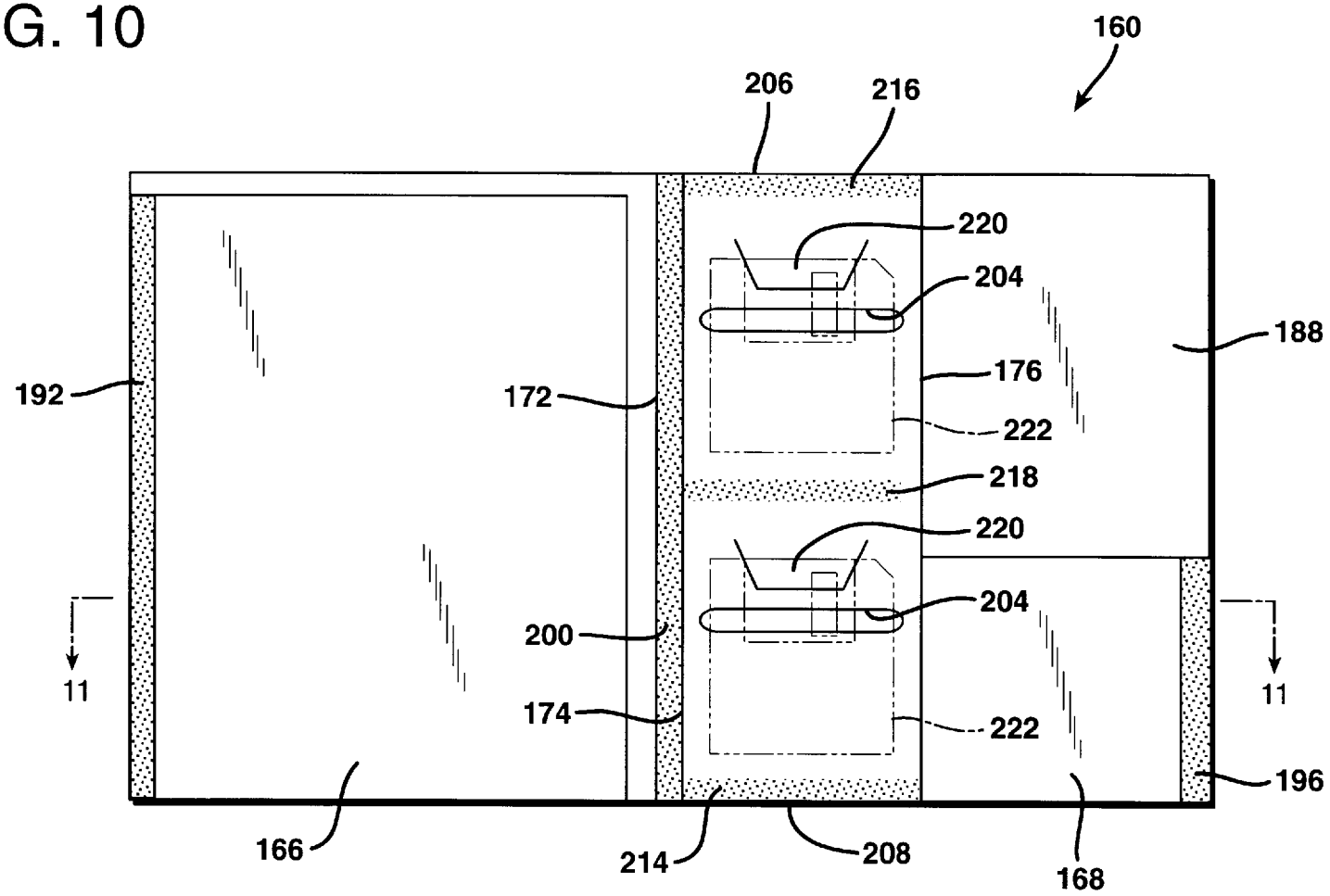
FIG. 10 is an elevational view of the folio of FIG. 8.
Figure 11:
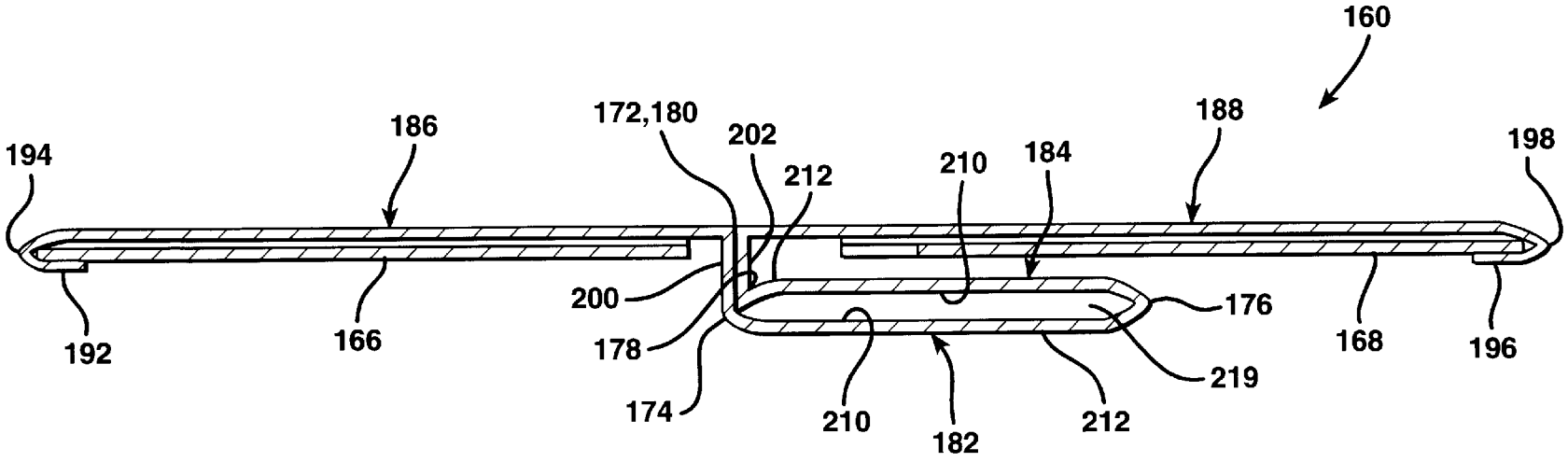
FIG. 11 is a sectional view taken along the lines of 11—11 of FIG. 10.
Figure 12:
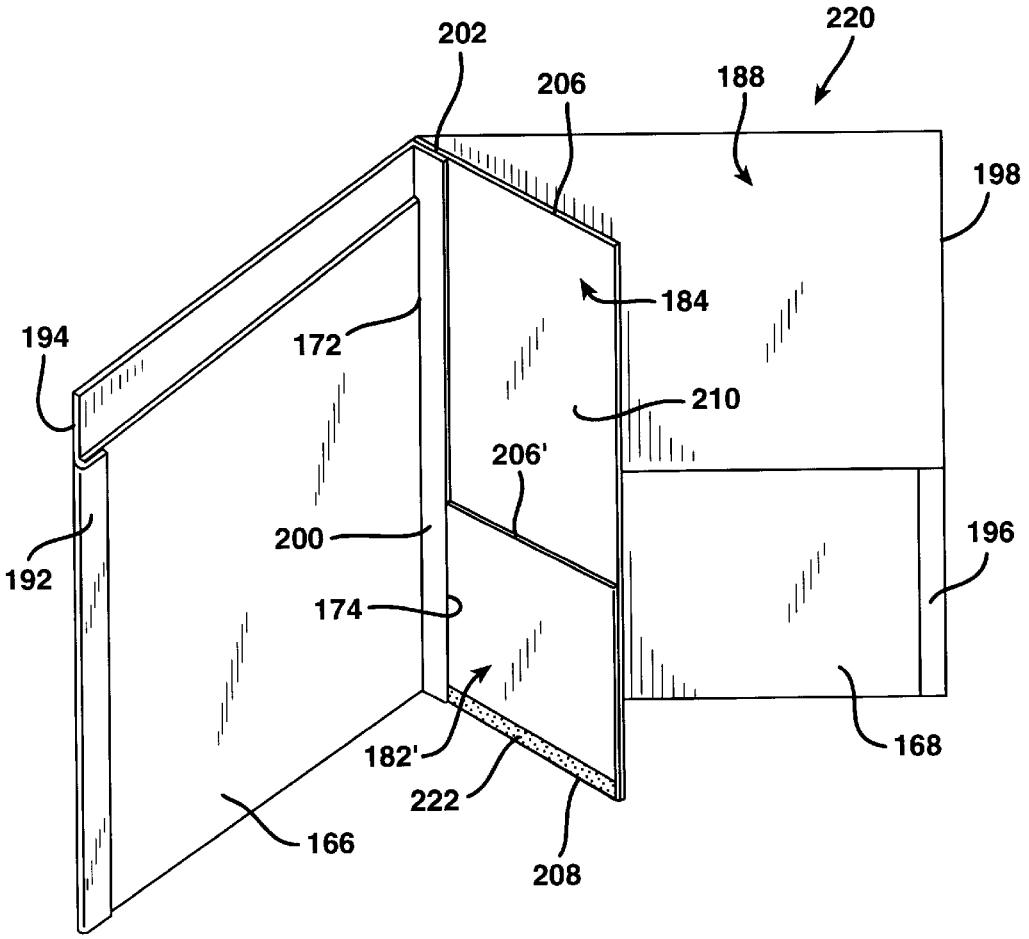
FIG. 12 is a perspective view of another alternative embodiment of a folio constructed according to the invention.

The interior panel 182 is die cut to form a pair of laterally elongated, narrow slots 204 that serve as pocket openings, one above another. The pocket opening slots 204 are oriented perpendicular to the longitudinal fold lines 174 and 176. As illustrated in FIG. 10, the die cut panel 182 has upper and lower edges 206 and 208. As illustrated in FIG. 11, the interior panels 182 and 184 each have a concealed surface 210 and an opposite, exposed surface 212.

The interior panels 182 and 184 are held in back-to-back disposition by virtue of the seal between the transition webs 200 and 202 with the planar concealed surfaces 210 disposed against each other. As indicated in FIG. 10, the lower edges 208 of the interior panels 182 and 184 are secured together throughout by means of an adhesive, sonic weld, or heat seal formed in the elongated, lower marginal region 214 immediately adjacent the lower edges 208 throughout the width of the interior panels 182 and 184. Likewise, the interior panels 182 and 184 are sealed together across their widths in the elongated upper marginal region 216 immediately adjacent their upper edges 206. The interior panels 182 and 184 are also sealed together across substantially their entire widths in the region indicated at 218 midway between the upper edges 206 and the lower edges 208. By virtue of the seals established in the regions 214 and 216, the interior panels 182 and 184 are secured together beneath both of the elongated pocket openings 204. A pair of pockets 219 are thereby formed above the sealed regions 214 and 218.

The interior panel 182 further defines a pair of die cut retaining flaps 220 of inverted trapezoidal shape a short distance above each of the pocket opening slots 204. As illustrated in phantom in FIGS. 9 and 10, the pocket openings 204 and the retaining flaps 220 are of a configuration designed to accommodate computer disks 222 that may be inserted into the pockets 219 through the pocket openings 204 and held in place by the retaining flaps 220. The pockets 219 thereby defined between the interior panels 182 and 184 are of a size and shape to snugly accommodate a pair of computer disks 222.

Figure 13:
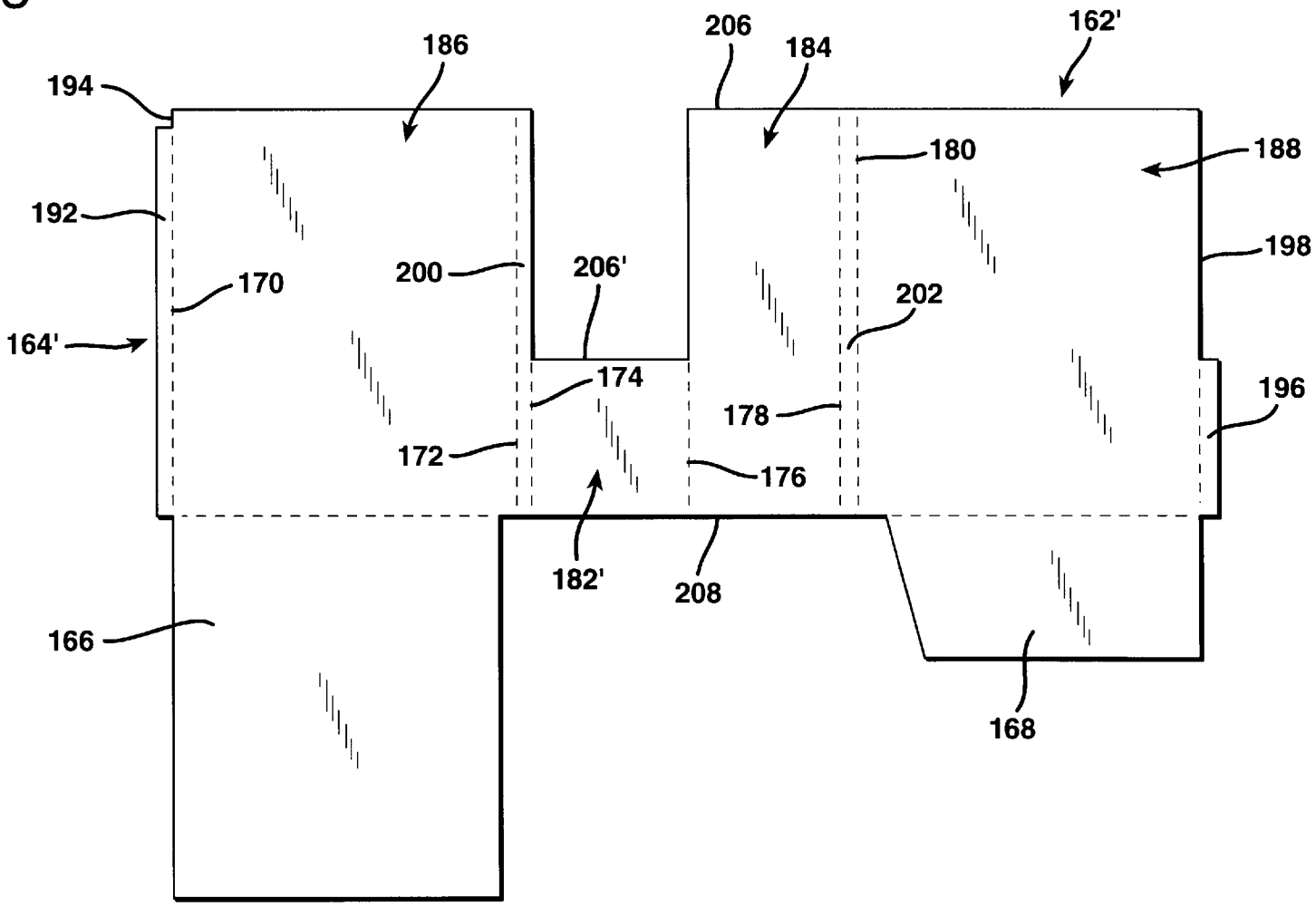
FIG. 13 is a top plan view illustrating the single sheet of panel stock employed in the fabrication of the folio of FIG. 12.
Figure 14:
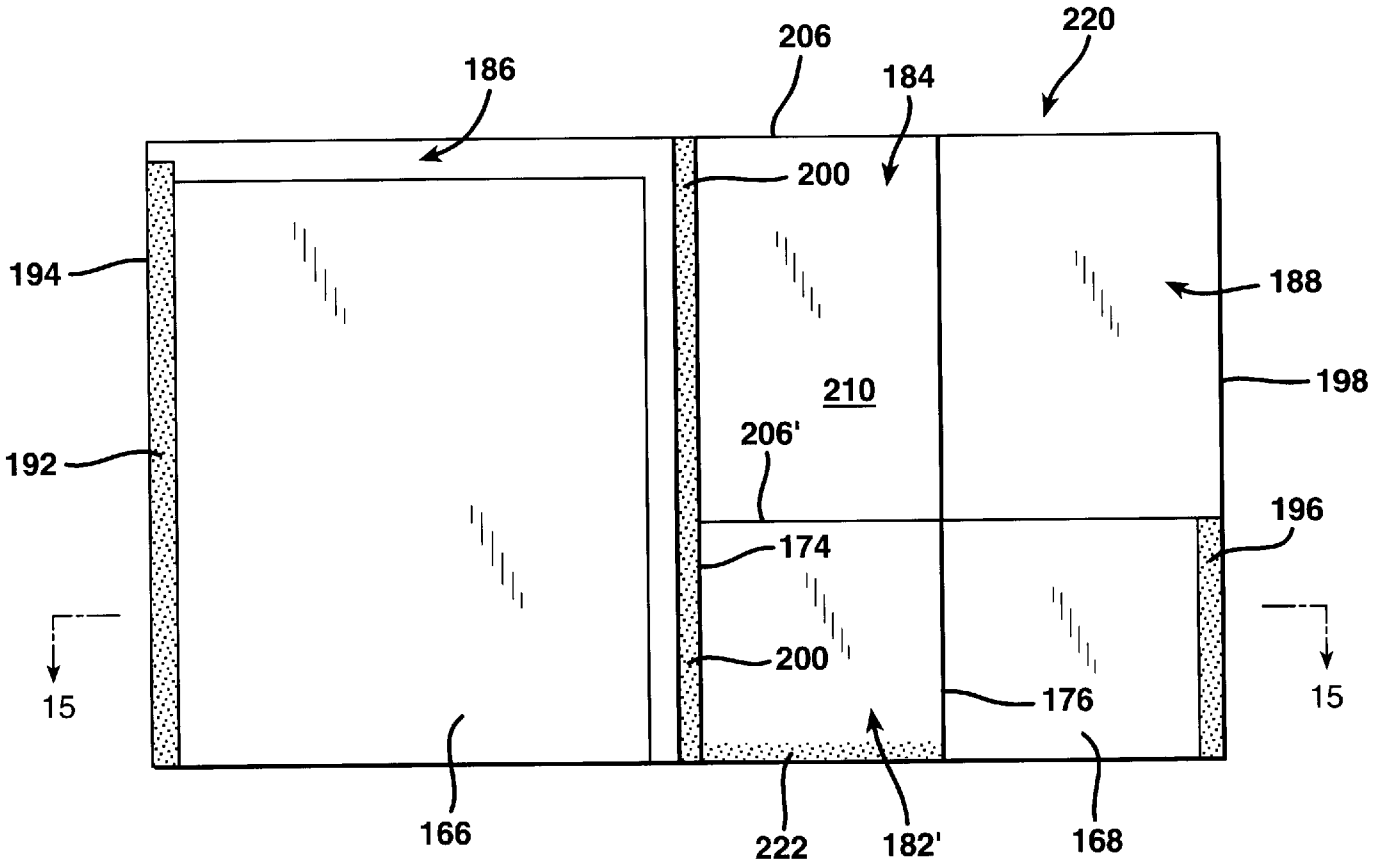
FIG. 14 is a front elevational view of the folio of FIG. 12.
Figure 15:
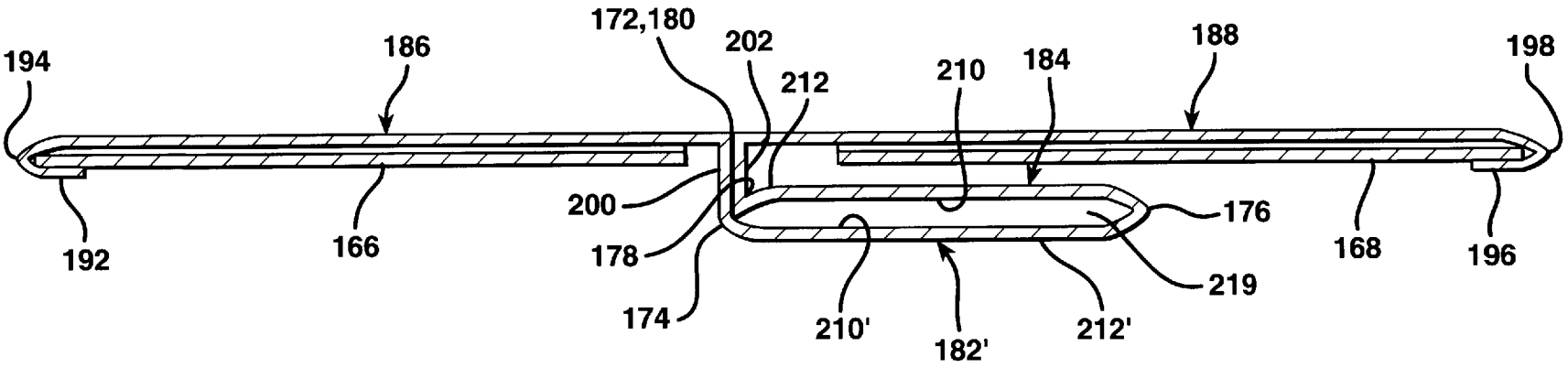
FIG. 15 is a sectional view taken along the lines of 15—15 of FIG. 14.

FIGS. 12–15 illustrate still another folio 220 constructed according to the invention. The folio 220 is similar in many respect to the folio 160, and elements common to both folios bear the same reference numbers. The principal difference of the folio 220 from the folio 160 resides in the construction of the interior panel 182' in the backing portion 164'. Both of the interior panels of the folio 220 have upper and lower edges. Specifically, the interior panel 184 of the folio 220 has an upper edge 206 and a lower edge 208, as in the folio 160. The interior panel 182' also has a lower edge 208 that is collinear with the lower edge 208 of the other interior panel 184 prior to folding the single sheet of stock 162' from which the folio 220 is formed, as illustrated in FIG. 13. However, the upper edge 206' of the interior panel 182' is recessed beneath the level of the upper edge 206 of the other interior panel 184.

As in the folio 160, the interior panel 184 has a planar surface 210 and an opposite, exposed surface 212. The planar surface 210 is only partially concealed. The interior panel 182' has a totally concealed, planar surface 210' and an opposite, exposed surface 212'. The interior panels 182' and 184 are held in back-to-back disposition with their respective planar surfaces 210' and 210 facing each other. The interior panels 182' and 184 are held in this manner by the adhesive, sonic weld, or heat seal bond that exists throughout the interface between the transition webs 200 and 202. This same bond also holds the bound edges of the side panels 186 and 188 together. These bound edges are respectively defined by the fold lines 172 and 180. Also, the lower edges 208 of the interior panels 182' and 184 are secured together throughout by an adhesive, sonic weld, or heat seal bond in the lower, transverse region indicated at 222 in FIGS. 12 and 14.

With the construction illustrated the folio 220 has side pockets formed by the side pocket flaps 166 and 168 with the side panels 186 and 188, the same as the folio 160. However, the interior panels 182' and 184 form a single pocket 219 that is accessible between the upper edge 206' of the interior panel 182' and the partially concealed surface 210 of the other interior panel 184. The pocket 219 formed between the two interior panels 182' and 184 is particularly suitable for receiving elongated pamphlets and brochures, which are typically on the order of between about three and four inches in width. The recessed, upper edge 206' of the interior panel 182' allows the upper portion of the brochure to be seen and recognized while the lower portion of the brochure is snugly seated in the interior panel pocket 219.

Figure 16:
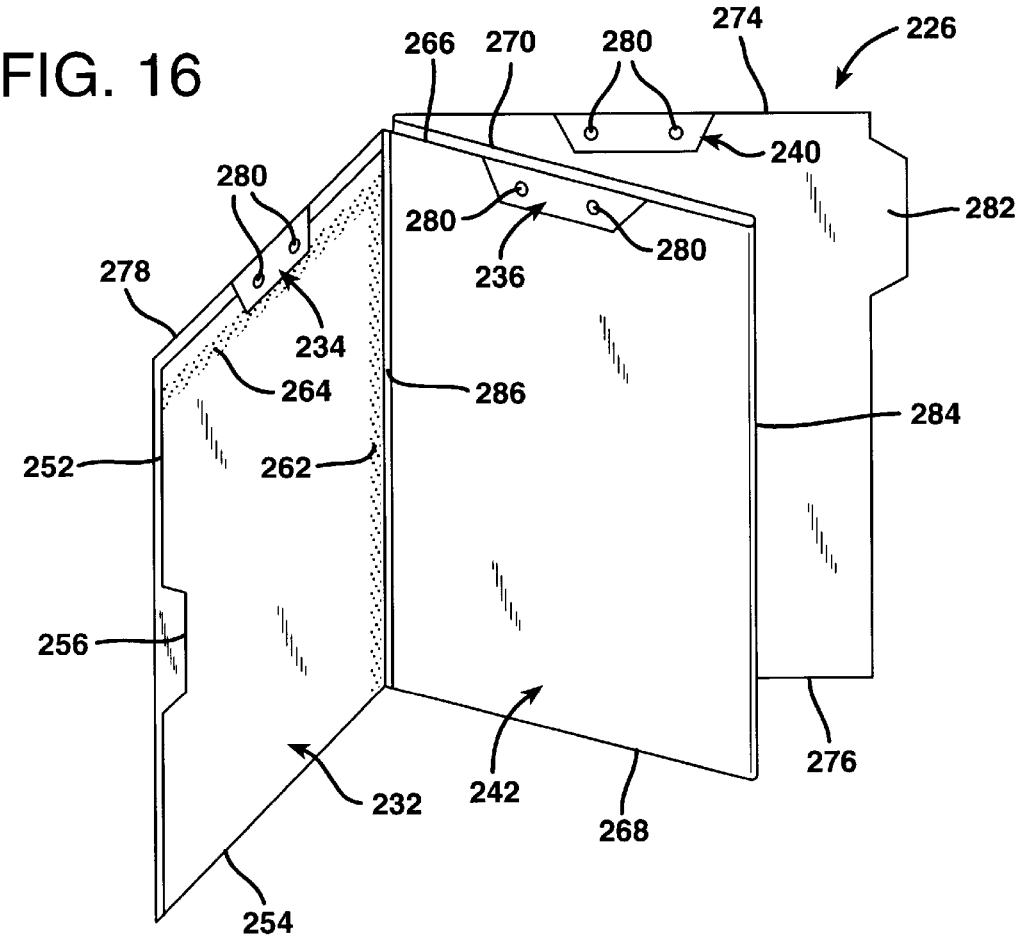
FIG. 16 is a perspective view of another alternative embodiment of a folio constructed according to the invention.
Figure 18:
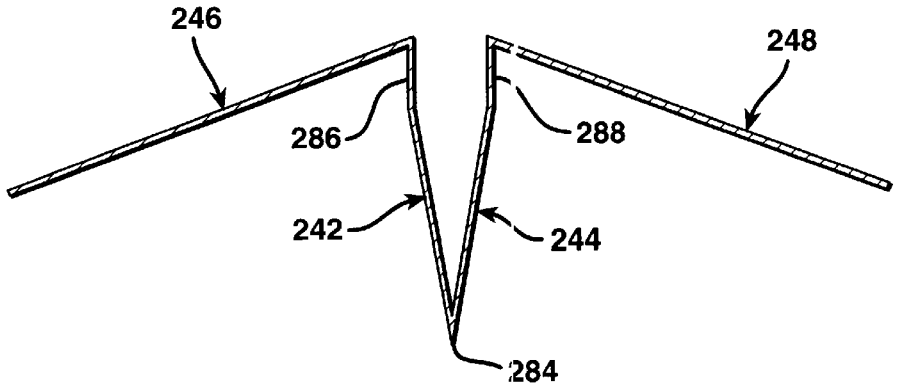
FIG. 18 is a sectional view taken along the lines of 18—18 of FIG. 17 showing the folio of FIG. 16 at an intermediate stage of construction.
Figure 17:
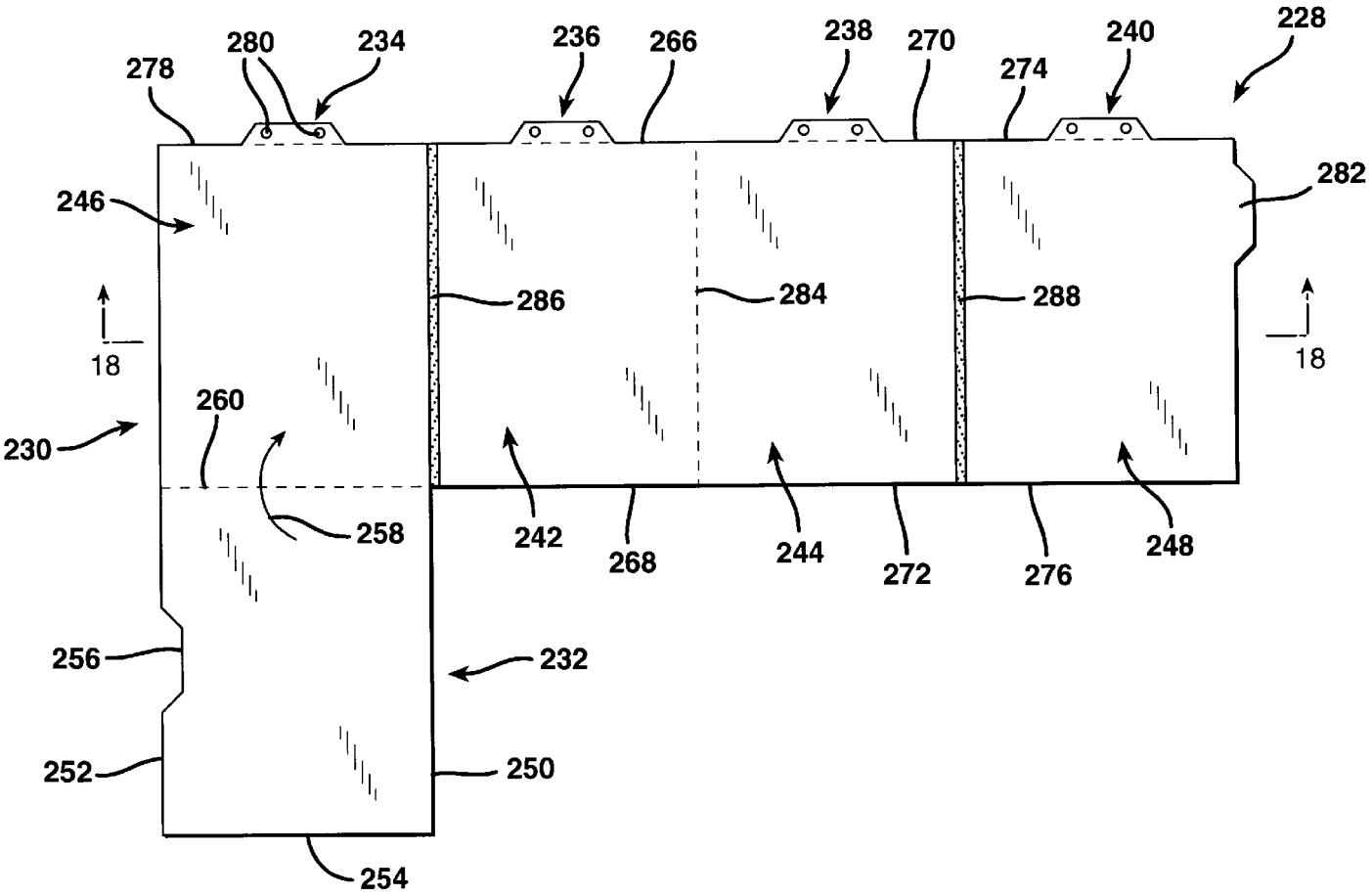
FIG. 17 is a top plan view of the single sheet of panel stock employed in the fabrication of the folio of FIG. 16.

FIGS. 16–18 illustrate another alternative embodiment of a folio 226 constructed according to the invention. As in the other embodiments, the folio 226 is comprised of a single, expansive sheet 228 of flat stock, typically stiff polypropylene plastic or cardboard stock. The sheet 228 is formed of a backing portion 230 and a plurality of document retention sections indicated at 232, 234, 236, 238, and 240. The backing portion 230 defines a pair of interior leaves 242 and 244 and a pair of side leaves 246 and 248.

A first one of the side panels 248 is provided with a laterally projecting tab 282 for accommodating a label identifying the contents of the folio 226, as well as the document attachment flap 240. The second side panel 246 has a document retention section 232 extending from its lower edge.

The document retention section 232 is a pocket flap and has a pair of side edges 250 and 252 and a transverse edge 254. The side edge 250 and the transverse edge 254 are linear, while the other side edge 252 has a central viewing and gripping notch 256 defined therein midway throughout its length.

In constructing the folio 226, the pocket flap 232 is folded upwardly against the side panel 246 from the lower edge of side panel 246 as indicated by the directional arrow 258 about the linear document retention section demarcation fold 260 that extends in the direction of the width of the sheet 228. The pocket flap 232 is secured to the side panel 246 at its marginal region 262 immediately adjacent to its side edge 250, and at its marginal region 264 immediately adjacent its transverse edge 254, as depicted in FIG. 16. The pocket flap 232 thereby forms a side-opening memo pocket suitable for receiving notes and other papers.

Each of the panels or leaves 242, 244, 246, and 248 has an upper edge and a lower edge. Specifically, the upper and lower edges of the interior panel 242 are indicated at 266 and 268, respectively. The upper and lower edges of the other interior panel 244 are indicated at 270 and 272, respectively. The upper and lower edges of the side panel 248 are indicated at 274 and 276, respectively. The upper edge of the side panel 246 is indicated at 278, while the lower edge of the side panel 246 is defined by the fold line 260.

The document retention portions 234, 236, 238, and 240 are all formed as narrow, generally trapezoidal-shaped document attachment flaps each having document holding apertures 280 defined therethrough. The document holding apertures 280 are typically one-quarter or five-sixteenths of an inch in diameter and spaced apart two and three-quarter inches so as to accommodate the spacing of a conventional, two-hole punch, typically employed to punch the tops of papers. The document attachment flaps 234, 236, 238, and 240 are respectively centered along the upper edges 278, 266, 270, and 274 of the panels in the backing portion 230 from which they extend. It is evident that when the document attachment flaps 234, 236, 238, and 240 are folded downwardly toward the leaves or panels from which they extend, as illustrated in FIG. 16, they can readily accommodate papers punched along their upper ends with a conventional two-hole punch by means of conventional pronged fasteners and compressors.

The interior panels or leaves 242 and 244 reside in mutually adjacent relationship and are joined in articulated fashion to each other by a fold along the fold line 284. The interior leaves 242 and 244 are also respectively joined to the side leaves 246 and 248 by narrow transition webs 286 an 288, which extend the entire length of the backing portion 230 and are secured together in back-to-back disposition by adhesive, sonic welding, or heat sealing, as indicated in FIG. 18.

Figure 19:
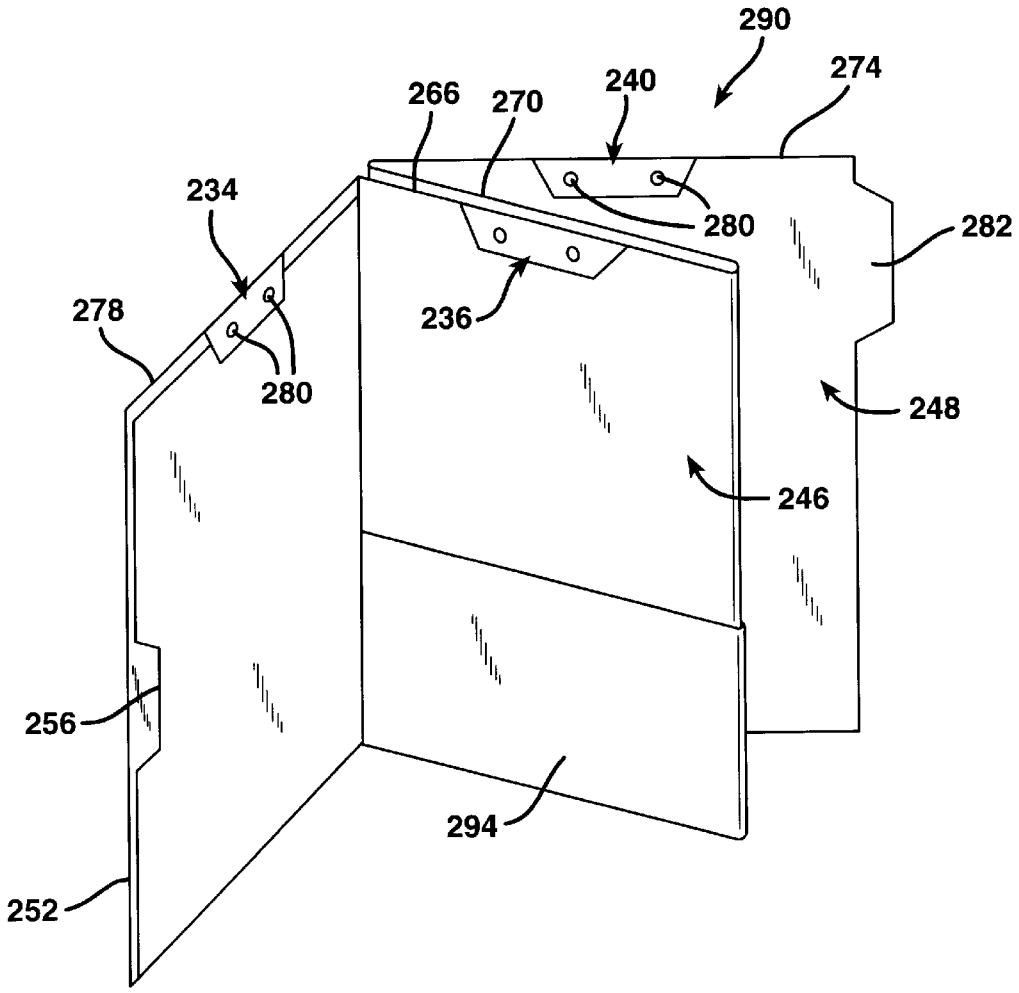
FIG. 19 is a perspective view of another alternative embodiment of a folio constructed according to the invention.
Figure 20:
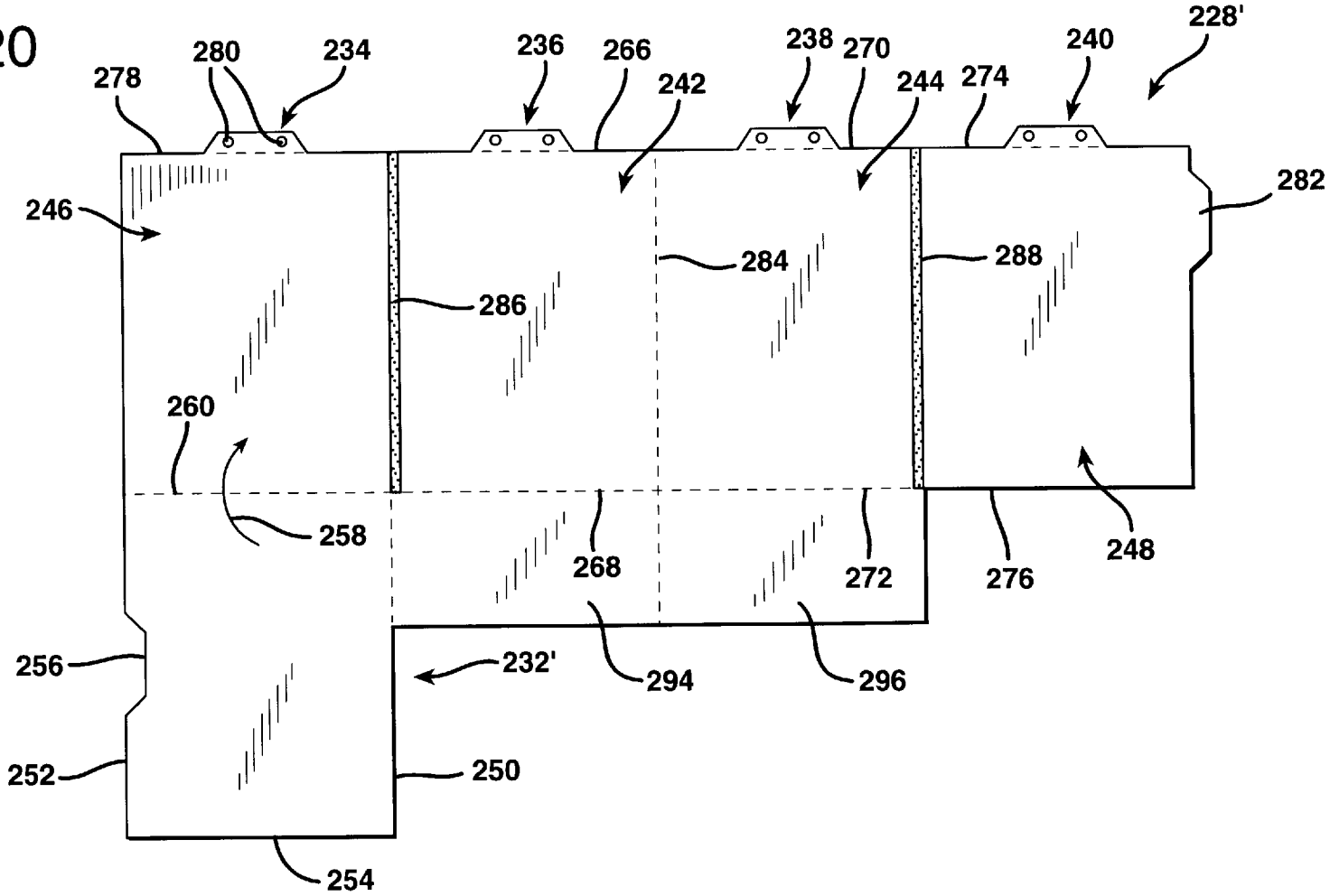
FIG. 20 is a top plan view of the single sheet of panel stock employed in the fabrication of the folio of FIG. 20.

FIGS. 19 and 20 illustrate another folio 290 constructed according to the invention. The folio 290 is similar in many respects to the folio 226, and elements common to both bear the same reference numbers. The folio 290 differs from the folio 226 in that the lower pocket flap 232' of the unfolded sheet 228' extends below the fold line 260 not only beneath the side panel 246, but also beneath both interior panels 242 and 244. Thus, when the pocket flap 232' is folded upwardly as indicated by the directional arrow 258, it forms not only a pocket with the leaf 246, but also separate pockets with each of the interior leaves 242 and 244. Also, the pocket flap 232' is sealed to the lower portions of the outwardly facing surfaces of the transition webs 286 and 288 by adhesive, sonic welding, or heat sealing so as to close both ends of the pockets formed with the interior leaves 242 and 244.

The portion 294 of the pocket flap 232' forms a top-opening pocket against the outwardly-facing surface of the interior leaf 242, while the portion 296 of the pocket flap 232' forms a top-opening pocket against the outwardly facing surface of the interior leaf 244. The pockets thus formed by the portions 294 and 296 of the pocket flap 232' are suitable for receiving computer disks, CD ROM discs, papers, and other articles useful in making sales or other business presentations or filing storage.

Figure 21:
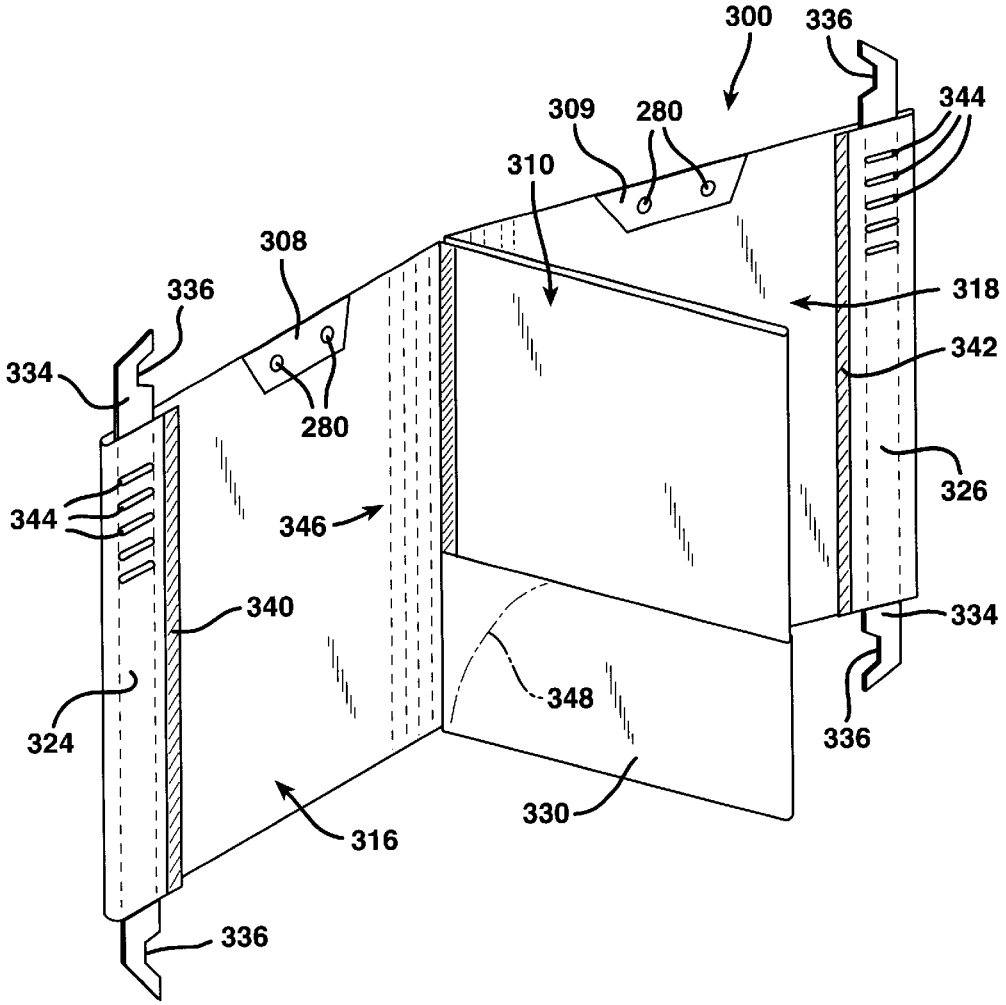
FIG. 21 is perspective view of still another alternative embodiment of a folio constructed according to the invention.
Figure 22:
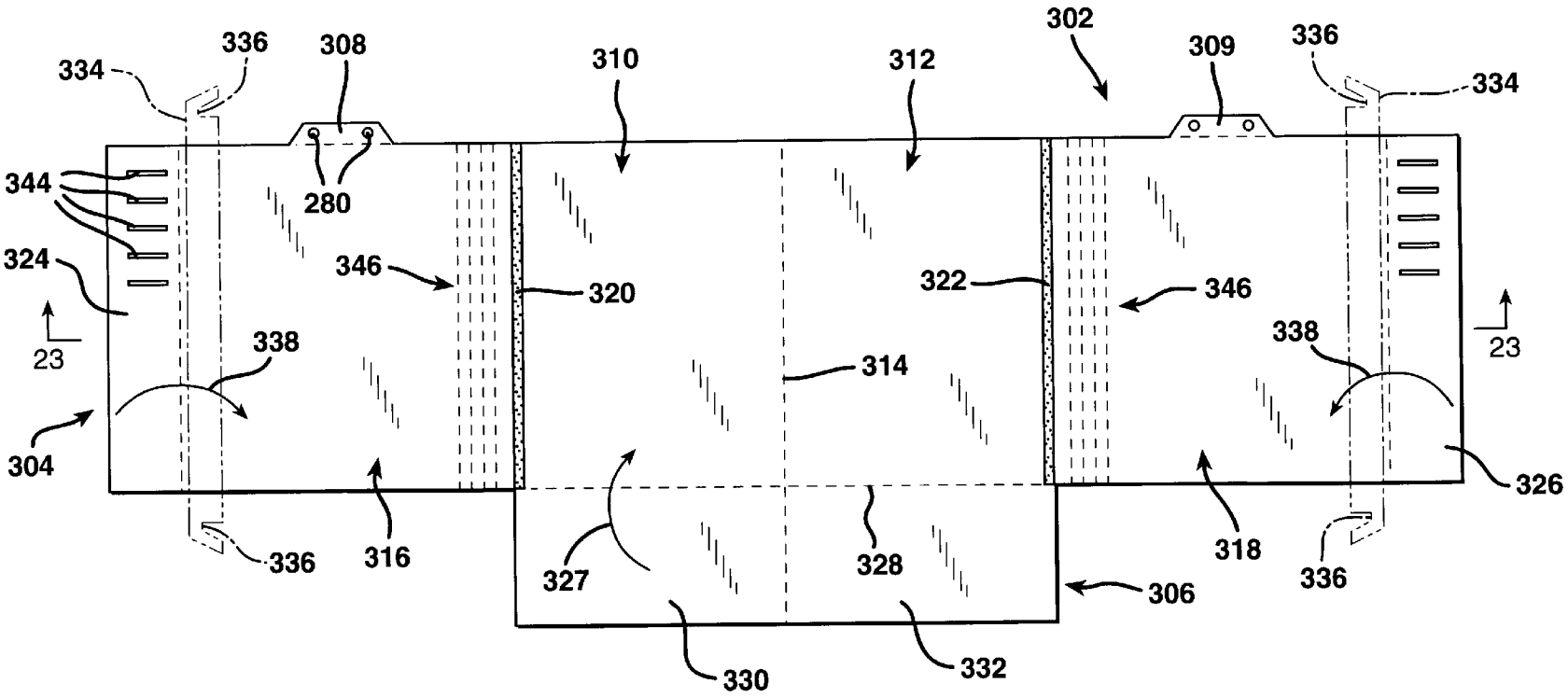
FIG. 22 is a top plan view of the single sheet of panel stock employed in the fabrication of the folio of FIG. 21.
Figure 23:
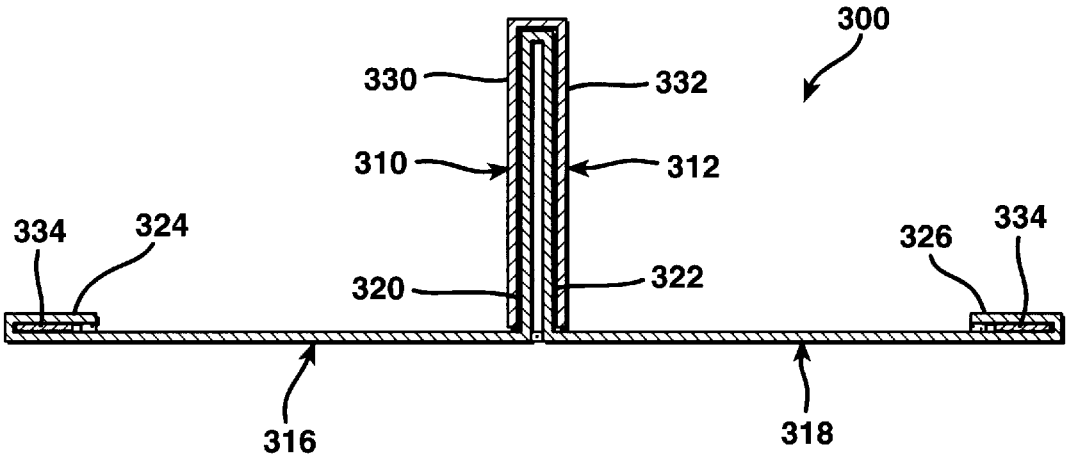
FIG. 23 is a sectional view taken along the lines 23—23 of FIG. 22 showing the completed folio of FIG. 21.

FIGS. 21 through 23 illustrate another embodiment of a folio 300 constructed according to the invention. The folio 300, like the other folios of the invention is comprised of a single sheet of stock 302 having a backing section 304. The sheet 302 also includes document retention portions in the form of a pocket flap 306 and document attachment flaps 308 punched with spaced apertures 280 as in the folio 226.

The folio 300 includes a pair of interior panels or leaves 310 and 312 joined to each other in articulated fashion by a fold 314. The folio 300 also includes a pair of side leaves 316 and 318 connected respectively to the interior leaves 310 and 312 by means of transition webs 320 and 322 of the type previously described. The folio 300 differs from the other embodiments of the invention described in that it is further comprised of hanging file sleeve extensions 324 and 326 extending laterally from the unbound edges of the side leaves 316 and 318, respectively.

To construct the folio 300, the pocket flap 306 is first folded up against the interior leaves 310 and 312 about the fold line 328 that forms the bottom edges of the interior leaves 310 and 312 as indicated by the directional arrow 327. The laterally opposite side edges of the pocket flap 306 are secured by adhesive, sonic welding, or heat sealing to the lower portions of the outwardly-facing surfaces of the transition webs 320 and 322 so as to close both ends of the pockets formed respectively by the portions 330 and 332 of the pocket flap 306 with the interior leaves 310 and 312. The transition webs 320 and 322 are then brought into back-to-back disposition, as illustrated in FIG. 23, and are sealed together with adhesive, sonic welding, or by heat sealing.

The folio 300 is further comprised of a pair of separate, elongated hanging file rods 334 having hooks 336 on both of their ends. The hanging file rods 334 are laid on the side panels 316 and 318 next to the sleeve flaps 324 and 236, as illustrated in phantom in FIG. 22. The sleeve flaps 324 and 326 are then folded over the hanging file rods 334 as indicated by the directional arrows 338 in FIG. 22. The sleeve extensions 324 and 326 are then secured respectively to the side leaves 316 and 318 in the regions indicated at 340 and 342 in FIGS. 21 and 23 to form sleeves that laterally encompass the hanging file rods 334. It is thereby evident that the folio 300 can be hung from a hanging file in the manner of a conventional hanging file folder.

As with conventional hanging file folders, label mounting slots 344 are defined in the hanging file rod sleeves formed by the sleeve flaps 324 and 326 to accommodate conventional index tabs. As illustrated in FIGS. 21 and 22, the hanging file rods 334 are attached to the folded sheet 302 by means of the sleeves formed by the sleeve flaps 324 and 326. The hanging file rods 334 extend beyond each of the side leaves 316 and 318 at the unbound edges thereof.

As illustrated in FIG. 21, the pockets formed on the interior leaves 310 and 312 are suitable for accommodating computer disks, papers, and other articles. Also, the side leaves 316 and 318 both include a series of longitudinal, parallel expansion fold lines indicated collectively at 346 in FIGS. 21 and 22 to accommodate different thicknesses of documents mounted on the document attachment flaps 308 and 309. It is to be understood that the pocket flap 306 need not necessarily be of any particular size or configuration. For example, the pocket flap 306 forming pockets on the interior leaves 310 and 312 could have rounded edges, indicated in phantom at 348 in FIG. 21.

Figure 26:
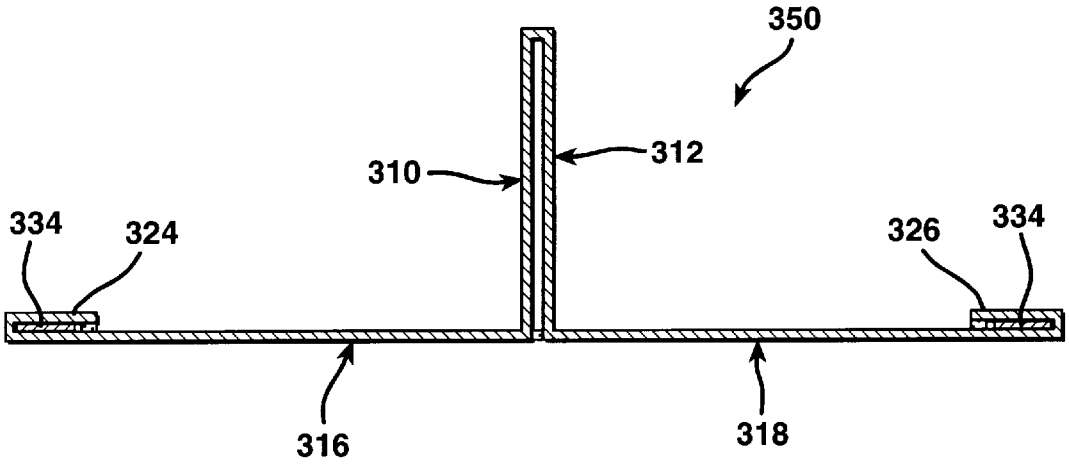
FIG. 26 is a sectional view taken along the lines 26—26 of FIG. 25 showing the complete folio of FIG. 24.
Figure 24:
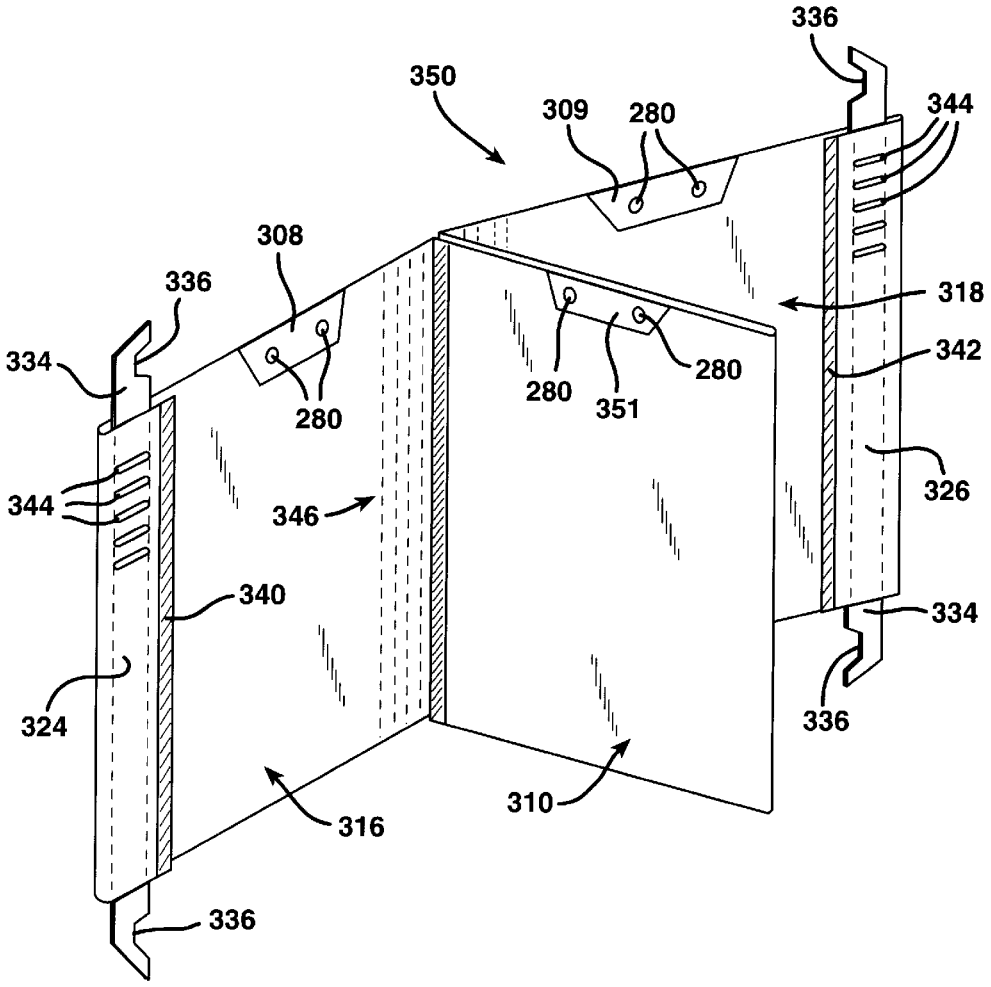
FIG. 24 is a perspective view of still another alternative embodiment of a folio according to the invention.
Figure 25:
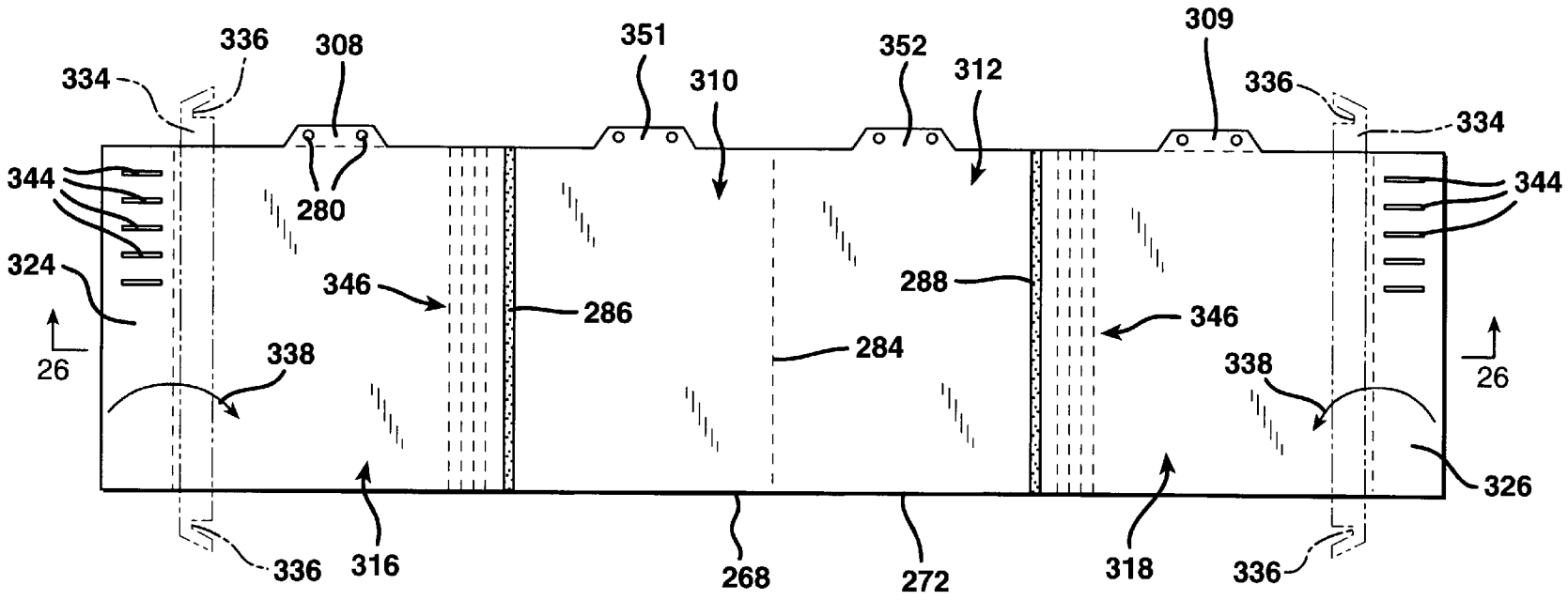
FIG. 25 is top plan view of the single panel sheet employed in the fabrication of the folio of FIG. 24 prior to folding.

FIGS. 24 through 26 illustrate another embodiment of a folio 350 constructed in accordance with the invention. The folio 350 is also formed as a hanging file folio and is similar in a number of respects to the folio 300. Elements common to the folios 300 and 350 bear the same reference numbers.

The folio 350 differs from the folio 300 in that the document retention sections are all formed as document retention flaps. Specifically, in addition to the document retention flaps 308 and 309 formed at the upper edges of the side leaves 316 and 318, the folio 350 includes similar document retention flaps 351 and 352 located at the upper edges of the interior leaves 310 and 312. Also, the folio 350 does not include any pocket flap depending from the lower edge of any of the leaves of the folio.

The folio 350 is illustrated in its complete form in FIG. 24. As is evident, papers punched at the top with a conventional two-hole punch can be attached to any or all of the document retention flaps 308, 351, 352, and 309. Thus, documents may be bound at the top in four different classifications within the folio 350. Like the folio 300, the folio 350 is particularly adapted for use as a hanging file.

As is evident, numerous variations and modifications of the invention are possible. For example, the pockets depicted in the various embodiments may be redesigned and configured in many different ways to accommodate particular items. For example, pockets may be configured to accommodate business cards, promotional brochures, lined pads of writing paper, forms, and any number of different types of documents and articles that are widely used in business. Also, the folio could be reconfigured so that the interior panels could be formed from one transparent sheet of material and the side panels could be formed of a separate sheet of opaque material. The two sheets, once folded to form the appropriate pockets could be joined together longitudinally at their centers. Accordingly, the scope of the invention should not be construed as limited to the specific embodiments depicted and described.

I claim:

1. A folio consisting of a sheet of flat, expansive panel stock having an upper region and a lower region wherein said lower region is folded upwardly against only a portion of said upper region about a laterally-extending, pocket-delineating fold and wherein said sheet is also folded longitudinally in articulated fashion to define a single pair of mutually-adjacent, interior panels and a single pair of side panels, a separate one of said side panels being joined to each of said interior panels by side panel delineating folds extending perpendicular to said pocket delineating fold, and each of said side panels has one bound edge and one unbound edge both extending perpendicular to said pocket delineating fold and said bound edges of said side panels are secured to each other throughout their lengths.

2. A folio according to claim 1 wherein said interior panels each have a planar surface and an opposing pocket bearing surface and further comprising fastening means holding said interior panels in back-to-back disposition with each other at said bound edges of said side panels with said planar surfaces of said interior panels disposed against each other.

3. A folio according to claim 2 wherein said sheet is provided with a closure flap extending laterally from said unbound edge of one of said side panels, and further comprising releasable closure means on said flap and on said other side panel for releasably holding said closure flap folded over said unbound edge of said other side panel.

4. A folio according to claim 1 further comprising pocket fastening tabs extending laterally from said sheet whereby said pocket fastening tabs secure said lower region of said sheet to said side panels.

5. A folio according to claim 1 wherein said lower region of said sheet of panel stock is formed of a pair of pocket flaps adjoining said side panels and folded thereagainst and secured thereto to form top opening pockets therewith.

6. A folio consisting of a single expansive sheet of flat stock formed of backing and document retention portions, said backing portion defining a single pair of interior leaves and a single pair of side leaves each having a length and a width, said document retention portion of said sheet of flat stock being folded perpendicular to said lengths of said leaves to only partially cover said backing portion and thereby form a document retainer on at least one of said leaves, and wherein said interior leaves reside in mutually adjacent relationship and are joined in articulated fashion to each other and to separate ones of said side leaves, and each of said side leaves has a bound edge and an unbound edge, and said side leaves are bound to each other throughout their lengths and along the entire length of their bound edges.

7. A folio according to claim 6 wherein each of said interior leaves has a concealed surface and an opposing document retention surface and further comprising fastening means at said bound edges holding said concealed surfaces of said interior panels in back-to-back relationship with each other.

8. A folio consisting of a single, expansive sheet of flat stock having a length, a width perpendicular to said length, a backing section, and at least one document retention section being delineated from each other by at least one linear document retention section demarcation fold extending in the direction of said width of said sheet whereby said backing section has a height less than said length of said expansive sheet of flat stock and longer than said document retention section as measured in a direction perpendicular to said document retention section demarcation fold, and wherein said at least one document retention section is folded in said backing section at said document retention section demarcation fold, a single pair of mutually-adjacent, interior panels formed in said backing section and delineated from each other by at least one interior, panel-separating fold that extends in the direction of the height of said sheet through said backing section and perpendicular to said at least one document retention section demarcation fold, and a single pair of side panels in said backing section each one of which has a pair of longitudinal side edges parallel to said direction of said height and each one of which resides adjacent to a separate one of said interior panels and is delineated therefrom by a separate side panel fold parallel to said direction of said height and extending throughout the entire height of said backing section, and one side edge of each of said side panels is secured throughout its length to a side edge of the other of said side panels.

9. A folio according to claim 8 wherein said at least one document retention section has side edges, at least one of which is secured to one of said panels to form a pocket thereon.

* * * * *